US005916739A

United States Patent [19]

Miyazawa et al.

[11] Patent Number: 5,916,739

[45] Date of Patent: Jun. 29, 1999

[54] SILVER HALIDE LIGHT SENSITIVE PHOTOGRAPHIC MATERIAL AND IMAGE FORMING METHOD BY USE THEREOF

[75] Inventors: Kazuhiro Miyazawa; Shigeo Tanaka, both of Hino, Japan

[73] Assignee: Konica Corporation, Japan

[21] Appl. No.: 08/972,943

[22] Filed: Nov. 18, 1997

[30] Foreign Application Priority Data

| | | | |
|---|---|---|---|
| Nov. 22, 1996 | [JP] | Japan | 8-312024 |
| Jan. 9, 1997 | [JP] | Japan | 9-002125 |
| Jun. 19, 1997 | [JP] | Japan | 9-162545 |

[51] Int. Cl.[6] ..... G03C 7/407

[52] U.S. Cl. ..... 430/373; 430/384; 430/385; 430/414; 430/943

[58] Field of Search ..... 430/373, 414, 430/943, 384, 385

[56] References Cited

U.S. PATENT DOCUMENTS

| | | | |
|---|---|---|---|
| 3,822,129 | 7/1974 | Dunn et al. | 430/373 |
| 3,923,511 | 12/1975 | Bissonette | 430/373 |
| 4,172,726 | 10/1979 | Nakamura et al. | 430/373 |
| 4,880,725 | 11/1989 | Hirai et al. | 430/943 |
| 4,954,425 | 9/1990 | Iwano | 430/373 |
| 5,182,339 | 1/1993 | Yokoyama et al. | 525/242 |
| 5,200,301 | 4/1993 | Wingender et al. | 430/373 |
| 5,215,875 | 6/1993 | Matejec et al. | 430/943 |
| 5,326,682 | 7/1994 | Yamakawa | 430/558 |
| 5,695,913 | 12/1997 | Nakamura et al. | 430/943 |
| 5,707,786 | 1/1998 | Schmuck | 430/943 |

FOREIGN PATENT DOCUMENTS

| | | |
|---|---|---|
| 03 04 856 | 3/1989 | European Pat. Off. . |
| 05 56 700 | 8/1993 | European Pat. Off. . |
| 05 85 679 | 3/1994 | European Pat. Off. . |
| 06 97 625 | 2/1996 | European Pat. Off. . |

OTHER PUBLICATIONS

European Search Report EP 97 12 0282.

European Patent Office—Patent Abstracts of Japan Publication #03111844, Publication Date: May 13, 1991.

*Primary Examiner*—Hoa Van Le

*Attorney, Agent, or Firm*—Jordan B. Bierman; Bierman, Muserlian and Lucas

[57] ABSTRACT

An image forming method of a silver halide light sensitive photographic material having at least one color image forming layer containing a silver halide emulsion and a dye forming coupler, the image forming method comprising the steps of exposing the photographic material to light and subjecting the exposed photographic material to amplification development to form a dye image, wherein the color image forming layer contains a coupler capable of forming a dye, upon development, having a molar extinction coefficient at a wavelength of an absorption maximum of 60,000 or more.

7 Claims, No Drawings

SILVER HALIDE LIGHT SENSITIVE PHOTOGRAPHIC MATERIAL AND IMAGE FORMING METHOD BY USE THEREOF

FIELD OF THE INVENTION

The present invention is related to a silver halide light sensitive photographic material which is capable of providing image with high maximum density, low minimum density and stably producing excellent tone reproduction upon amplification development, and an image forming method by use thereof.

BACKGROUND OF THE INVENTION

Silver halide light sensitive photographic materials, which have superior properties such as high sensitivity and excellent tone reproduction as compared to other print materials, are broadly employed. An image forming method has been known, employing amplification development of a silver halide photographic material, in which advantageous effects of the silver halide photographic material are displayed, the consumed amount of silver halide can be reduced, and which is preferable in terms of effective usage of natural resource. As examples of the amplification development is cited a method in which an oxidized color developing agent is formed by using an oxidizing agent such as hydrogen peroxide or a cobalt (III) complex in the presence of developed silver as a catalyst and subsequently, a dye image is formed upon reaction with a coupler.

In conventional color development, an oxidized developing agent which takes part in dye image-forming, results from redox reaction between the developing agent and silver halide having a latent image, so that the amount of silver halide to be used in the photographic material is optimally adjusted in proportion to that of the coupler. After reached a sufficient density, there is shown behavior such that the characteristic curve changes slightly, for a while, in a manner of parallel displacement. Thus, as a result of a region in which an increase of the minimum density is substantially restrained (a so-called saturated stable region) being present, there can be consistently obtained characteristics of only a little increase of the minimum density, which is important in print material, even when development is prolonged. In amplification development, contrarily, an oxidized developing agent which takes part in dye image-forming, is produced from a redox reaction between the developing agent and an oxidizing agent, in which the developing agent and the oxidizing agent are generally present in excess, as compared to the coupler to achieve sufficient reaction. As a result, even after the amplification development proceeds and reaches a sufficient density, contrast at a higher density portion still varies and an appreciable increase of the minimum density occurs. Thus, there is little or no region such as a saturated stable region, as in conventional development, so that even slightly prolonged development tends to result in a marked increase of the minimum density. Obviously, improvements thereof are desired.

A photographic material having on a support plural layers capable of forming different color image is conventionally employed to obtain color images. When such photographic material is subjected to amplification development, there tends to occur a so-called interlayer effect in which variation of the dye forming amount in the upper layer affects kinetics of development in the lower layer, making it difficult to stably reproduce contrast. In conventional color development, even if development in the upper layer affects developability of the lower layer, developing time can be adjusted so as to obtain optimum development of the lower layer within the time the upper layer is in the saturated stable region, leading to characteristics of little increase of the minimum density and variation of contrast or contrast balance, which are important for print materials. In the amplification development, however, the above-described saturated stable region is not present, so that, when the dye forming amount of the upper layer changes with exposure, its effect on the lower layer can not be compensated for by adjusting the developing time, making difficult stable tone reproduction. This phenomenon is marked in the case when the dye forming amount varies in a dye image forming layer farthest from )or uppermost on) a support, and improvements thereof are sought.

Variation in developability of the lower layer due to the variation of the dye forming amount of the upper layer becomes inappreciable, when the time for amplification development is shortened. However, shortening of the amplification development results in insufficient maximum density. Accordingly, there is incompatibility between a higher maximum density and lower minimum density, and stable tone reproduction of the lower layer in response to variation of the dye forming amount of the upper layer.

SUMMARY OF THE INVENTION

An objective of the present invention is to provide a silver halide light sensitive photographic material which is capable of providing image with high maximum density, low minimum density and stably giving excellent tone reproduction upon amplification development and an image forming method by use thereof.

The above objective can be accomplished by the following constitution:

(1) A silver halide light sensitive photographic material comprising a support having thereon a color image forming layer containing a silver halide emulsion and a coupler, wherein the color image forming layer contains a coupler capable of forming a dye upon amplification development, said dye having a molar extinction coefficient ($\epsilon$) at a wavelength of an absorption maximum of 60, 000 or more;

(2) the silver halide photographic material described in (1), wherein the coupler capable of forming a dye having a molar extinction coefficient at an absorption maximum wavelength of 60,000 or more is a cyan dye forming coupler;

(3) the silver halide photographic material described in (2), wherein the cyan coupler has a structure represented by the following formula (I), (II) or (III):

Formula (I)

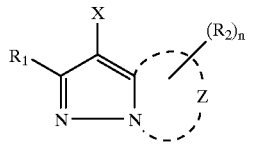

wherein $R_1$ represents a hydrogen atom or a substituent; $R_2$ represents a substituent bonded to a carbon atom included in a nonmetallic atomic group, provided that at least one of $R_1$ and $R_2$ is selected from an electron-withdrawing group and a group capable of forming a hydrogen bond; n exhibits a number of the substituent $R_2$; X represents a hydrogen atom or a group capable of being released upon reaction with an oxidation product of a color developing agent; and Z represents a non-metallic atom group necessary for forming an azole ring, which may be condensed with a benzene ring;

Formula (II)

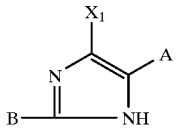

wherein A and B independently represents a substituent bonded to a imidazole ring through a carbon atom, nitrogen atom, oxygen atom or sulfur atom; and $X_1$ represents a hydrogen atom or a group capable of being released upon reaction with an oxidation product of a color developing agent;

Formula (III)

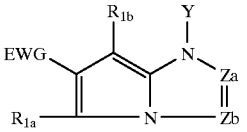

wherein Za represents —C($R_3$)=0 or —N=; when Za is —N=, Zb represents —C($R_3$)= and when Za is —C($R_3$)=, Zb represents —N=, in which $R_3$ represents a hydrogen atom or a substituent; $R_{1a}$, $R_{1b}$ and Y independently represent a hydrogen atom or a substituent; EWG represents an electron-withdrawing group having a Hammett's substituent constant ($\sigma_p$) of 0.3 or more;

(4) a silver halide light sensitive photographic material comprising a support having thereon at least two color image forming layers, each containing a silver halide emulsion and a coupler, wherein a color image forming layer provided farthest from the support contains a coupler capable of forming a dye upon amplification development, the dye having a maximum molar extinction coefficient ($\epsilon$) at a wavelength of an absorption maximum;

(5) the silver halide photographic material described in (1) through (4), wherein the color image forming layer of the photographic material contains a silver halide emulsion comprising silver halide grains having an average silver chloride content of 80 mol % or more.

(6) the silver halide photographic material described in (1) through (5), wherein the amount of silver halide, based on silver, contained in a color image forming layer provided farthest from the support is 5 to 60 mg/$m^2$;

(7) the silver halide photographic material described in (1) through (6), wherein a color image forming layer provided farthest from the support contains a cyan coupler having a structure represented by the above-described formula (I), (II) or (III)

(8) An image forming method, characterized in that the silver halide photographic material described in (1) through (7) is subjected to amplification development.

DETAILED DESCRIPTION OF THE INVENTION

The photographic material relating to the present invention is characterized in that there is contained a coupler capable of forming a dye upon amplification development, the dye having a molar extinction coefficient ($\epsilon$) at a wavelength of an absorption maximum of 60,000 or more, or that a color image forming layer provided farthest from the support contains a coupler capable of forming a dye upon amplification development, said dye having a maximum molar extinction coefficient ($\epsilon$) at a wavelength of an absorption maximum. With respect to the latter case, in a photographic material having on a support a yellow image forming layer, a magenta image forming layer and a cyan image forming layer in this order from the support, e.g., it means that the value of $\epsilon$ of an image forming dye formed in the cyan image forming layer, which is provided farthest from the support, is the largest, as compared to that of the dye formed in the magenta image forming layer or yellow image forming layer.

In the invention, $\epsilon$ of the image forming dye can be determined from absorbance at the wavelength(s) of maximal absorption obtained by measuring the absorption spectrum of a solution prepared by dissolving a given amount of the dye in an organic solvent (in this case, methanol is employed), by use of a spectrophotometer. In cases where plural image forming dyes are formed in a single color image forming layer of a photographic material, summation of a product of $\epsilon i$ of each dye and an existing ratio ($m_i$: molar fraction) of each coupler in the layer is calculated and its value is defined as $\epsilon$ of the image forming dye formed in the color image forming layer (thus, $\epsilon=\Sigma_i \epsilon i m_i$). In the invention, the molar extinction coefficient ($\epsilon$) at a wavelength of an absorption maximum is preferably 100,000 or less and more preferably 65,000 to 80,000.

In cases where at least one coupler is incorporated which forms a dye, upon amplification development, having a mole extinction coefficient ($\epsilon$) of 60,000 or more at the wavelength of absorption maximum, it is possible to shorten the amplification-developing time necessary for obtaining a desired maximum density. When subjected to amplification development, the color density of an exposed portion increases immediately after the start of the development. In an unexposed portion, on the other hand, regions having only a little increase of fog density (fogging-induction region) exists initially and thereafter, the fog density tends to rapidly increase. The fogging-induction region does not depend so much on the kind of couplers. Although the reason for occurrence of the fogging induction region is not completely understood, it is presumed that the region corresponds to the period of time until fogging development of silver halide proceeds to some extent and thereafter, the fog density increases rapidly due to amplification development. Thus, shortening of the amplification-developing time results in an increase of the proportion accounted for by the fogging induction region, and therefore, the high maximum density and low minimum density according to the effect of the invention become compatible.

According to the invention, it is preferred that an image forming dye formed upon amplification development, in a color image forming layer provided farthest from the support, has a maximum molar extinction coefficient at a wavelength of an absorption maximum ($\epsilon$). It is considered important to control color forming reactions in the uppermost color image forming layer, based on the following reasons. One reason is that in almost all cases, a photographic material having at least three different color image forming layers is conventionally employed to obtain color images and in this case, the upper-most image forming layer affects the other two lower image forming layers, which are closer to the support. Another reason is that the extent of effects on the lowest image forming layer is greater from the upper-most image forming layer than from the intermediate image forming layer.

The ϵ of the image forming dye formed is maximum in the layer farthest from the support of a photographic material relating to the invention, as compared to the ϵ of other color image forming layer(s) Specifically when the ϵ is 65,000 or more, there is an increase of freedom with respect to parameters used in the design of a photographic material, such as the thickness of the image forming layer and the ratio of a binder to oil, other than the amount of silver halide, which is preferable for enhancement of overall printing quality.

As couplers used in the photographic material relating to the invention are employed compounds capable of forming, upon coupling reaction with an oxidized developing agent, a coupling product having an absorption maximum at the wavelengths of 340 nm or larger. Representative examples thereof include a coupler capable of forming an yellow dye having an absorption maximum in a wavelength region of 350 to 500 nm, a coupler capable of forming a magenta dye having an absorption maximum in a wavelength region of 500 to 600 nm and a coupler capable of forming a cyan dye having an absorption maximum in a wavelength region of 350 to 500 nm.

The cyan coupler represented by formula (I), (II) or (III) is preferred in terms of being marked in effects of the invention and superior in improvements in color reproduction.

The coupler represented by formula (I) will be further explained in more detail, as below. In formula (I), at least one substituents represented by $R_1$ and $R_2$ is one selected from an electron-withdrawing group and a group capable of forming a hydrogen bond. The electron-withdrawing group refers to one having a Hammett's substituent constant (σp) of 0.3 or more, and examples thereof include a cyano group, nitro group, sulfonyl group (e.g., octylsulfonyl, phenylsulfonyl, trifluoromethylsulfonyl, pentafluorophenylsulfonyl), β-carboxyvinyl group, sulfinyl group (e.g., t-butylsulfinyl, tolylsulfinyl, trifluoromethylsulfinyl, pentafluorophenylsulfinyl), β, β-dicyanovinyl group, halogenated alkyl group (e.g., trifluoromethyl, perfluorooctyl, ω-hydroperfluorododecyl), formyl group, carboxyl group, carbonyl group (e.g., acetyl, pivaloyl, benzoyl, trifluethacetyl), alkyl- or aryloxycarbonyl group(e.g., ethoxycarbonyl, phenoxycarbonyl), 1-tetrazolyl group, 5-chloro-1-tetrazolyl group, carbamoyl group (e.g., dodecylcarbamoyl, phenylcarbamoyl), and sulfamoyl group (e.g., trifluoromethylsulfamoyl, phenylsulfamoyl, ethylsulfamoyl). Of these are preferred a cyano group, sulfonyl group, sulfinyl group, and halogenated alkyl group.

The group capable of forming a hydrogen bond refers to one having a hydrogen atom capable of forming a hydrogen bond with a nitrogen atom on a pyrazoloazole ring in such a strength that when the pyrazoloazole type coupler is reacted with an oxidized developing agent, a dye exhibiting an absorption maximum at the wavelengths of 580 to 700 nm in methanol is formed. Thus, a dye formed color development exhibits cyan color as a result of forming a strong hydrogen bind between the hydrogen atom and the nitrogen atom on a pyrazoloazole ring and the coupler therefore is a cyan dye forming coupler. As representative examples of the substituting group having a hydrogen atom capable of forming the above-described hydrogen bond with a nitrogen atom on a pyrazoloazole ring are cited the following substituents.

(1)

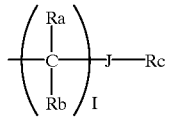

(2)

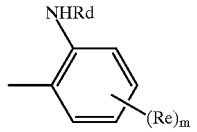

wherein Ra, Rb, Rc and Rd independently represent a hydrogen atom or a substituent; Re represents a substituent; J represents —$SO_2$NH—, —SONH— or —CONH—; 1 is 0 or 1; m is an integer of 0 to 4, provided that when m is 2 or more, Res may be the same with or different from each other.

Preferred examples of Ra, Rb and Rc include a hydrogen atom, an alkyl group, aryl group or heterocyclic group, or a sulfonyl group or sulfinyl group, which may be substituted. Preferred examples of Rd include a hydrogen atom, an alkyl group, aryl group or heterocyclic group, or a sulfonyl group, sulfinyl group or carbonyl group, which may be substituted, and of these are preferred a sulfonyl group, sulfinyl group or carbonyl group, which may be substituted. The substituent represented by Re is not specifically limited, and the substituent represented by Re is preferably an alkylgroup, aryl group, alkyloxy group, aryloxy group, acylamino group, sulfonamido group, halogen atom, hydroxy group or carboxyl group.

In formula (I), of the substituents represented by $R_1$ and $R_2$, representative examples of those other than the electron-withdrawing group and group capable of forming a hydrogen bond include an alkyl group, aryl group, anilino group, acylamino group, sulfonamido group, alkylthio group, arylthio group, alkenyl group, cycloalkyl group, cycloalkenyl group, alkynyl group, heterocyclic group, alkoxy group, heterocyclic-oxy group, siloxy group, amino group, alkylamino group, imido group, ureido group, sulfamoylamino group, alkoxycarbonylamino group, aryloxycarbonylamino group, alkoxycarbonyl group, aryloxycarbonyl group, heterocyclic-thio group, thioureido group, hydroxy group, mercapto group, spiro-compound residue and bridged hydrocarbon compound residue.

The alkyl group is preferably one having 1 to 32 carbon atoms, which may be straight-chained or branched. The aryl group is preferably a phenyl group. The acylamino group includes an alkylcarbonylamino group and arylcarbonylamino group. The sulfonamido group includes alkylsulfonylamino group and arylsulfonylamino group. An alkyl or aryl component in the alkylthio group and the arylthio group includes the above-described alkyl group and aryl group. The cycloalkyl group is preferably one having 2 to 32 carbon atoms; and the alkenyl group, which may be straight-chained or branched, is preferably one having 3 to 12 carbon atom and more preferably 5 to 7 carbon atoms. The cycloalkenyl group is preferably one having 3 to 12 carbon atoms and more preferably 5 to 7 carbon atoms. The ureido group includes an alkylureido group and arylureido group; the sulfamoylamino group includes an alkylsulfamoylamino group and arylsulfamoylamino group; the heterocyclic group is preferably 5 to 7-membered one and examples thereof include 2-furyl, 2-thienyl, 2-pyrimidinyl and 2-benzothiazolyl; the heterocyclic-oxy group is preferably 5 to 7-membered one, and examples thereof include 3,4,5,6-tetrahydropiranyl-2-oxy group and 1-phenyltetrazole-5-oxy group; the heterocyclic-thio group is preferably 5 to 7-membered one and examples thereof include 2-pyridylthio, 2-benzothiazolylthio, 2,4-diphenoxy-1,3,5-triazole-6-thio; the siloxy group includes trimethylsiloxy, triethylsiloxy and dimethylbutylsiloxy; the imido group includes succinic acid imido, 3-heptadecylsuccinic acid imido, phthalic acid imido and glutarimido; the spiro-compound residue includes spiro[3,3]heptane-1-yl; and the bridged hydrocarbon compound residue includes bicyclo[2.2.1]heptane-1-yl, tricyclo[3.3.1.1$^{3,7}$]decane-1-yl and 7,7-dimethyl-bicyclo[2.2.1]heptane-1-yl. These groups maybe substituted by a group, such as a ballast group including a long-chained hydrocarbon group and polymer residue.

Examples of the group represented by X in formula (I), which is capable of being released upon reaction with an oxidation product of a color developing agent, include a halogen atom (e.g., chlorine atom, bromine atom, fluorine atom), analkoxy group, aryloxy group, heterocyclic-oxy group, acyloxy group, sulfonyloxy group, group, aryloxy-carbonyl group, alkyloxalyloxy group, alkoxyoxalyloxy group, alkylthio group, arylthio group, heterocyclic-thio group, alkyloxythiocarbonylthio group, acylamino group, sulfonamido group, a nitrogen containing heterocyclic group having a bonding site at a nitrogen atom, alkyloxycarbony-lamino group, aryloxycarbonylamino group and a group represented by the following formula:

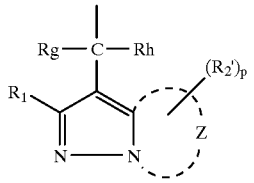

in which $R_1'$ and $R_2'$ each are the same as defined in $R_1$ and $R_2$, p is the same as defined in above-described n, Rg and Rh each are a hydrogen atom, an alkyl group, aryl group and heterocyclic group, and Z' is the same as defined in Z above-described. Of these is preferably a halogen atom. Thus, X is more preferably a hydrogen atom or a chlorine atom.

A nitrogen containing ring formed through Z (i.e., azole ring) includes a pyrazole ring, an imidazole ring, a benz-imidazole ring, a triazole ring and a tetrazole ring.

Next, a coupler represented by formula (II) will be further explained, as below. Among the substituents represented by A or B in formula (II), examples of the substituent bonded, through a carbon atom, to the ring include an alkyl group {e.g., methyl, i-propyl, t-butyl, trifluoromethyl, benzyl, 3-(4-aminophenyl)propyl, allyl, 2-dodecyloxyethyl, 3-phenoxypropyl, 2-hexylsulfonylethyl, 3-[4-(4-dodecyloxybenzene)sulfonamidophenyl[propyl, 1-methyl-2-[(2-octyloxy-5-t-octylphenyl)sulfonamidophenyl]ethyl, 1-methyl-2-[2-octyloxy-5-(2-octyloxy-5-t-octylphenylsulfonamido)-phenylsulfonamido]ethyl, 2-[2-octyloxy-5-(2-octyloxy-5-t-octylphenylsulfonamido) phenylsulfonamido]ethyl}; aryl group {e.g., phenyl, naphthyl, 2,4-dichlorophenyl, 2-hydroxy-5-methylphenyl, 2-acetoamidophenyl, 2-methanesulfonamidophenyl, 2-butaneamidophenyl, 2-(N,N-dimethylsulfamoylamino) phenyl, 2-(4-dodecyloxybenzenesulfonamido)phenyl, 2--[2-2,4-di-t-amylphenoxy)hexaneamido]phenyl, 2-(2-octyloxy-5-t-octylphenylsulfonamido)phenyl, 4-carbamoylphenyl, 4-cyanophenyl, 4-carboxyphenyl, 4-ethoxycarbonylphenyl}; a heterocyclic group (e.g., 4-pyridyl, 2-benzoimidazolyl); a cyano group; a carboxyl group; an acyl group; a carbamoyl group; an alkoxycarbonyl group and an aryloxycarbonyl group.

Examples of the substituent bonded, through a nitrogen atom, to the ring include an acylamino group (e.g., acetoamido, benzamido, 2,4-di-t-amylphenoxyacetoamido, 2,4-dichlorobenzamido, etc.), an alkoxycarbonylamino group (e.g., methoxycarbonylamino, propoxycarbonylamino, t-butoxycarbonylamino, etc., an aryloxycarbonylamino group (e.g., phenoxycarbonylamino, etc.), a sulfonamido group (e.g., methanesulfonamido, octanesulfoneamido, benzenesulfonamido, 4-dodecyloxybenzenesulfonamido, etc., an anilino group (e.g., phenylamino, 2-chloroanilino, 2-chloro-4-tetradecaneamidoanilino, etc., an ureido (e.g., N-methylureido, N-butylureido, N-phenylureido, N,N-dibutylureido, etc.), a sulfamoylamino group (e.g., N,N-diethylsulfamoylamino, N-phenylsulfamoylamino, etc.), an amino group (e.g., unsubstituted amino, N-methylamino, N,N-diethylamino, etc.), a heterocyclic group (e.g., 3,5-dimethyl-1-pyrazolyl, 2,6-dimethylmorpholino, etc.).

Examples of the substituent bonded, through an oxygen atom, to the ring include an alkoxy group (e.g., methoxy, ethoxy, i-propoxy, butoxy, 2,2,2-trifluoroethoxy, 3,3,3-trifluoropropoxy, 2-chloroethoxy, 2-cyanoethoxy, 2-butanesulfonylethoxy, etc.), an aryloxy group [e.g., phenoxy, 4-methoxyphenoxy, 2,4,dichlorophenoxy, 4-(2-ethylhexaneamido)phenoxy,etc.], a silyloxy group (e.g., trimethylsiliyloxy, dimethylphenylsilyloxy, dimethyl-t-butylsilyloxy, etc.), a heterocyclic-oxy group [e.g., tetrahydropiranyloxy, 3-pyridyloxy-2-(1,3-benzoimidazolyl)oxy, etc.].

Examples of the substituent bonded, through a sulfur atom, to the ring include an alkylthio group {e.g., methylthio, ethylthio, butylthio, 3-[4-(4-dodecyoxybenzene)sulfonamidophenyl]propylthio, 4-(2-butoxy-5-t-octylphenylsulfonamido)benzylthio, etc. }, an arylthio group (e.g., phenylthio, 2-naphthylthio, 2,5-dichlorophenylthio, 4-dodecylphenylthio, 2-butoxy-5-t-octylphenylthio, etc.), a heterocyclic-thio group [e.g., 2-pyridylthio, 2-(1,3-benzoxazolyl)thio, 1-hexadecyl-1,2,3,4-tetrazolyl-5-thio, 1-(3-N-octadecylcarbamoyl)phenyl-1,2,3,4-tetrazolyl-5-thio, etc.].

In formula (II), at least one of A and B is preferably an aryl group.

Examples of the group represented by $X_1$ in formula (I), which is capable of being released upon reaction with an oxidation product of a color developing agent, include a halogen atom (e.g., chlorine atom, bromine atom, fluorine atom), hydroxy, an alkoxy group, aryloxy group, heterocyclic-oxy group, acyloxy group, sulfonyloxy group, alkoxycarbonyloxy group, aryloxycarbonyl group, alkylox-alyloxy group, alkoxyoxalyloxy group, alkylthio group, mercapto group, arylthio group, heterocyclic-thio group, alkoxythiocarbonylthio group, acylamino group, substituted amino group, sulfonamido group, a nitrogen containing heterocyclic group having a bonding site at a nitrogen atom, alkyloxycarbonylamino group, and aryloxycarbonylamino group. Of these is preferably a halogen atom and more preferably a chlorine atom.

The coupler represented by formula (III) will be further explained, as below. The coupler is further represented by the following formula (IIIa) through (IIId).

Formula (IIIa)

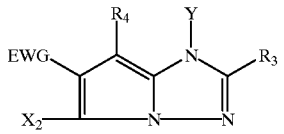

Formula (IIIb)

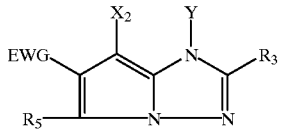

Formula (IIIc)

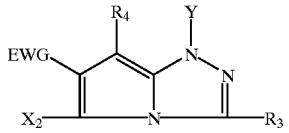

Formula (IIId)

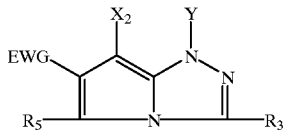

In the formulas, the substituent represented by $R_3$, $R_4$ and $R_5$ is not limitative, but representative examples thereof include the same as the substituents other than the electron-withdrawing group and the group capable of forming a hydrogen atom, among the substituents represented by $R_1$ and $R_2$ in formula (I), and further thereto, are also included a halogen atom, a sulfonyl group, sulfinyl group, phosphonyl group, acyl group, carbamoyl group, sulfamoyl group, cyano group, acyloxy group, sulfonyloxy group, carbamoyloxy group, carboxyl group, nitro group, and sulfo group.

Thus, the sulfonyl group includes an alkylsulfonyl group and arylsulfonyl group; the sulfinyl group includes alkylsufinyl group and arylsulfinyl group; the phosphonyl group includes an alkylphosphonyl group, alkoxyphosphonyl group, aryloxyphosphonyl group and arylphosphonyl group; the acyl group includes an alkylcarbonyl group and arylcarbonyl group; the carbamoyl group includes an alkylcarbamoyl and arylcarbamoyl group; the sulfamoyl group includes an alkylsulfamoyl and arylsulfamoyl group; the acyloxy includes an alkylcarbonyloxy group and arylcarbonyloxy group; the sulfonyloxy group includes an alkylsulfonyloxy group and arylsulfonyloxy group; and the carbamoyloxy group includes an alkylcarbamoyloxy group and arylcarbamoyloxy group.

Of the above-described substituents represented by $R_4$ and $R_5$ are preferred electron-withdrawing groups having a Hammett's substituent constant ($\sigma p$) of 0.3 or more. These substituents are the same as defined, as an electron-withdrawing group, in $R_1$ and $R_2$ of formula (I).

In formulas (IIIa) through (IIId), EWG includes the same groups as defined as an electron-withdrawing group in $R_1$ and $R_2$ of formula (I). Of the groups represented by EWG are preferred a cyano group, sulfonyl group, sulfinyl group and halogenated alkyl group.

A group represented by $X_2$, which is capable of being released upon reaction with an oxidation product of a developing agent, includes the same as X in formula (I). Of the groups represented by $X_2$ are preferred a hydrogen atom, a halogen atom, an alkoxy group, an aryloxy group, an alkylthio group, an arylthio group and a nitrogen containing heterocyclic group having a bonding site at a nitrogen atom.

Y represents a hydrogen atom or a substituent. The substituent is preferably a group capable of being released upon reaction with an oxidation product of a developing agent. Examples of the substituent represented by Y include a group releasable under an alkaline condition, as described in JP-A 61-228444 and a group capable of being coupling-off upon reaction with an oxidation product of an developing agent, as described in JP-A 56-133734.

Exemplary examples of the cyan couplers which are represented by formula (I), (II) or (III) and preferably employed in the invention, include cyan couplers described in JP-A 1-224761 at page 8, right lower column to page 13, right upper column; cyan couplers described in JP-A 2-235056 at page 7 right lower column to page 14, left upper column; cyan couplers described in JP-A 8-171185 at pages 4 to 10; cyan couplers described in JP-A 8-339060 at pages 5 to 11; compounds described in JP-A 7-140617 at pages 12 to 19; and cyan couplers described in JP-A 9-127660 at pages 50 to 62.

Examples of the coupler having $\epsilon$ of 60,000 or more are shown below, but the invention is not limited to these examples.

I-1

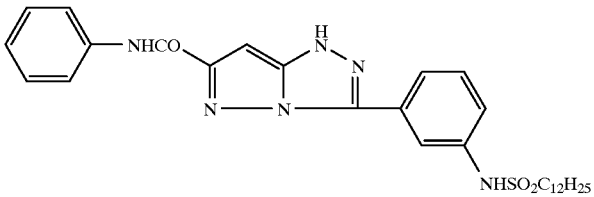

$\varepsilon(\times 10^4)$ 6.9

-continued
I-2
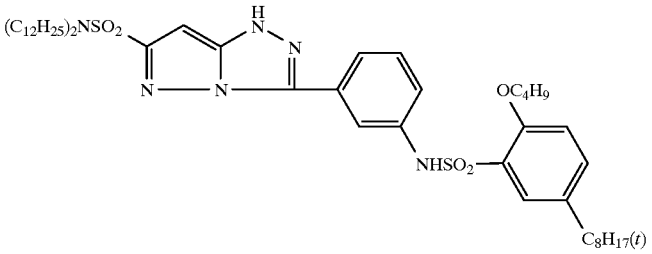
6.6
I-3
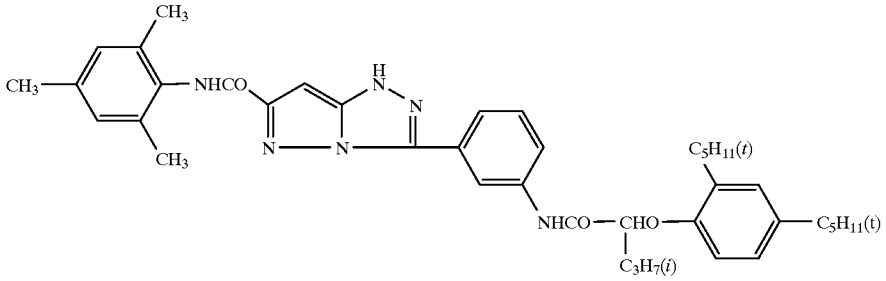
7.0
I-4
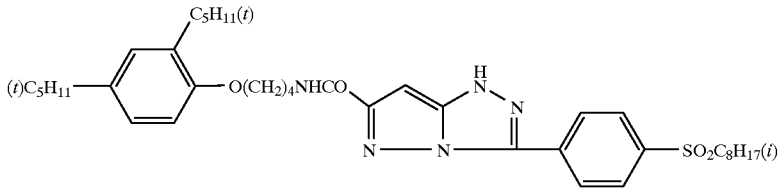
7.2
I-5
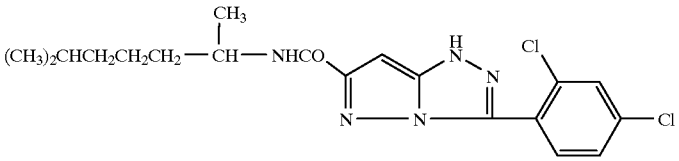
7.2
I-6
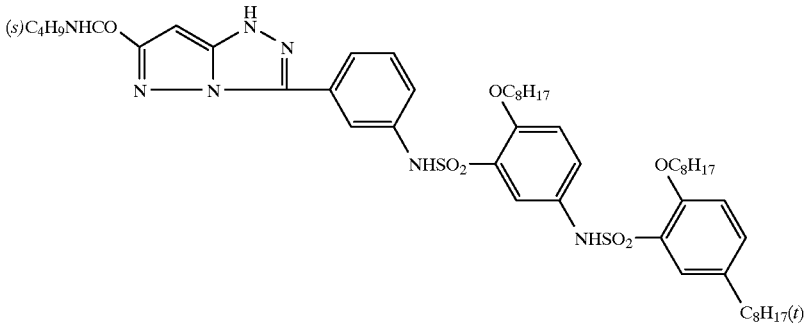
7.0

-continued
I-7
ε(x 10⁴)
7.1
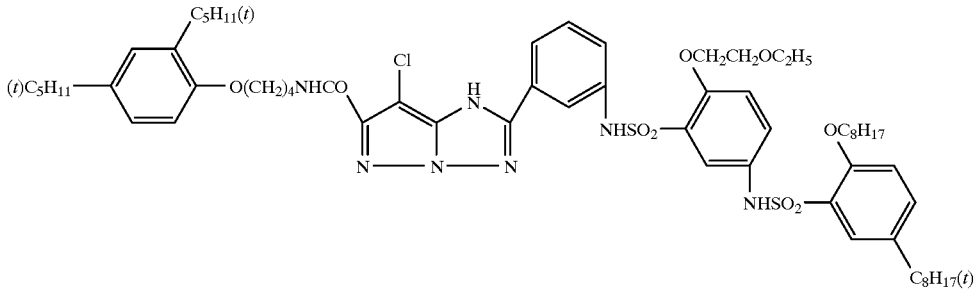
I-8
7.0
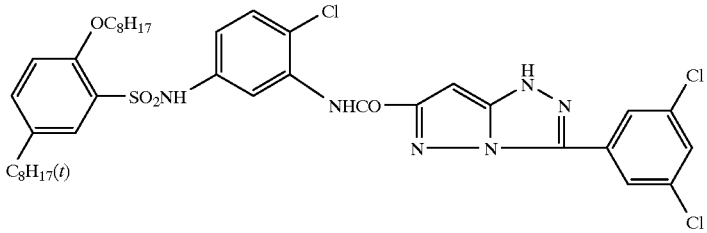
I-9
7.2
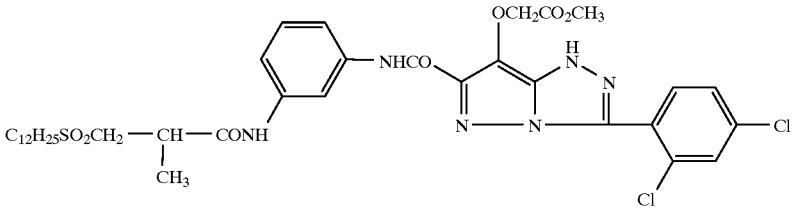
I-10
7.1
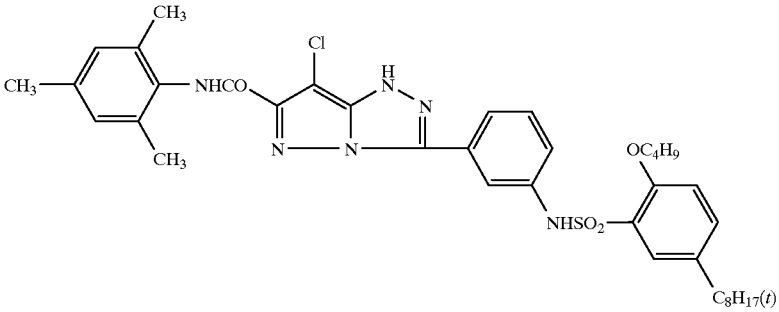
I-11
7.3
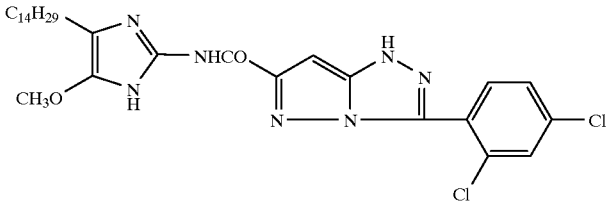

-continued
I-12
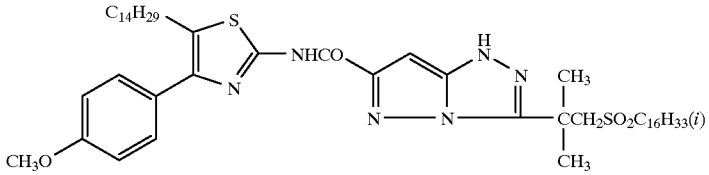
6.6
II-1
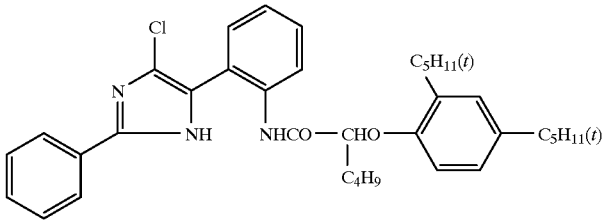
ε(× 10⁴)
7.2
II-2
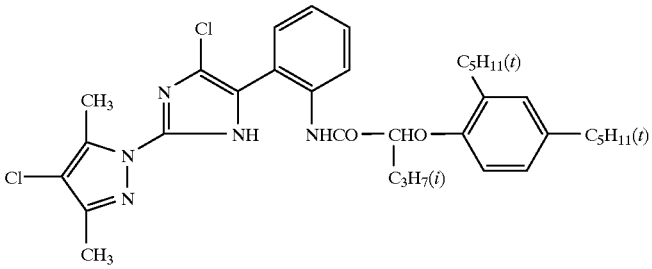
7.5
II-3
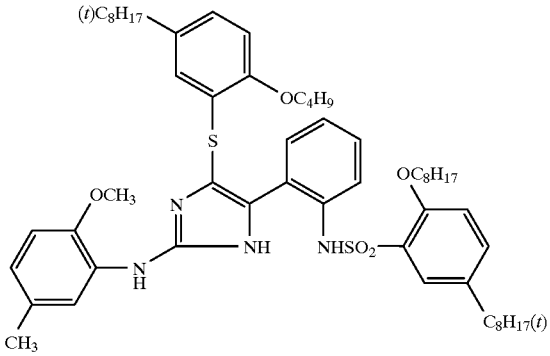
7.1
II-4
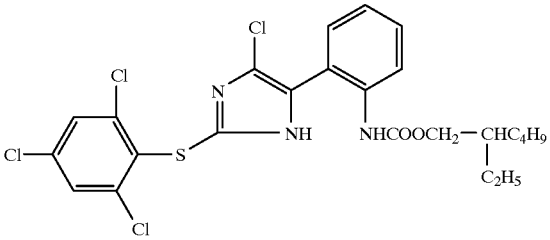
7.2

-continued
II-5
7.5
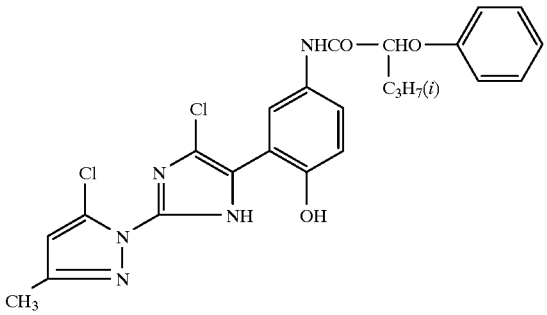
III-1
$\varepsilon(\times 10^4)$
7.6
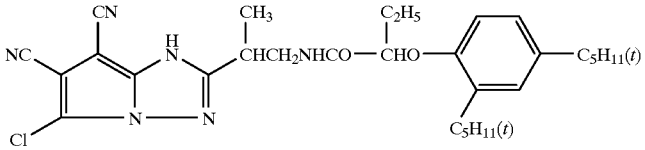
III-2
7.3
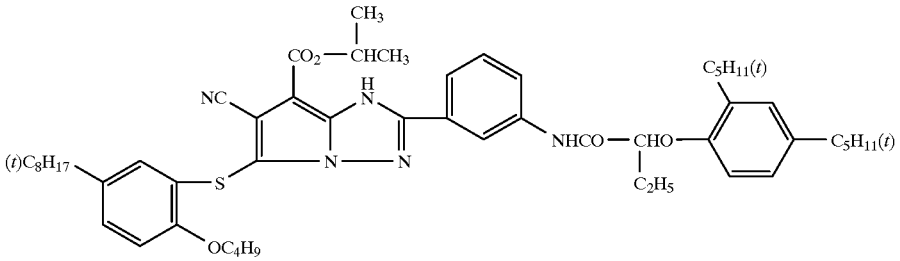
III-3
7.6
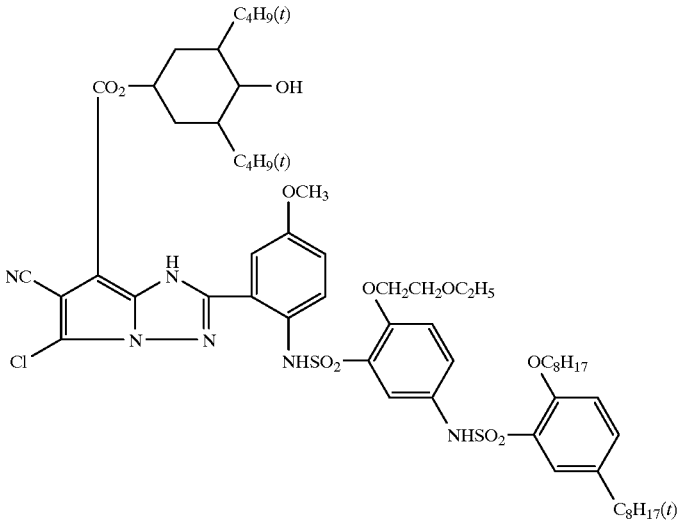

-continued

III-4

7.4

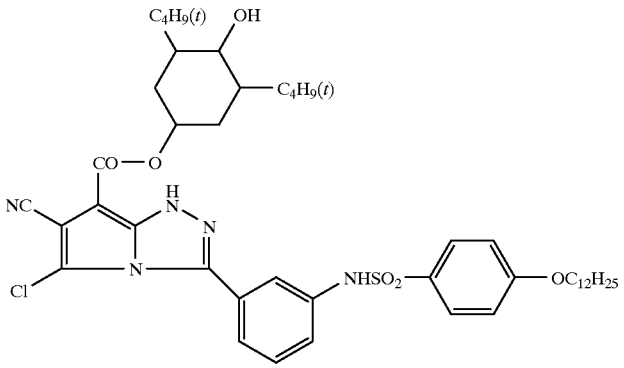

III-5

7.5

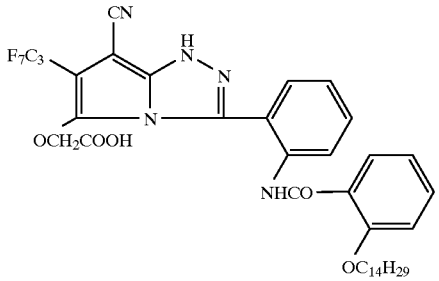

As cyan couplers other than the couplers represented by formula (I), (II) or (III), which can be used singly or in combination with the coupler represented by formula (I), (II) or (III), are cited couplers represented by formula (C-I) or (C-II) described in JP-A 4-144154 at page 5 left lower column.

Examples of magenta couplers preferably used in the photographic material employed in the invention include couplers represented by formula (M-I) of (M-II) described in JP-A 4-114154 at page 4, right upper column. Of these couplers are preferred those represented by formula (M-I). A coupler which has a tertiary alkyl group as RM of formula (M-I), is more preferable in terms of being superior in light fastness. Thus, a magenta coupler represented by the following formula (2) or (3) is preferably used:

Formula (2)

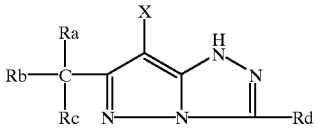

Formula (3)

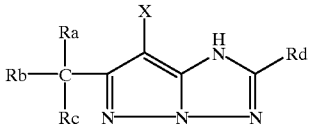

In the formulas, Ra, Rb, Rc and Rd independently represent a hydrogen atom or a substituent, provided that two or more of Ra, Rb and Rc is not hydrogen atoms. Two of Ra, Rb and Rc may combine with each other to form a ring. A substituents represented by Ra, Rb and Rc is not limitative, and preferably an alkyl group, aryl group, cycloalkyl group, hetrocyclic group, halogen atom, hydroxy group, alkoxy group, anilino group, acylamino group, or sulfonamido group and more preferably an alkyl group. A substituent represented by Rd is preferably an alkyl group, aryl group, cycloalkyl group, hetrocyclic group, halogen atom, anilino group, acylamino group, sulfonamido group, alkoxy group, aryloxy group, heterocyclic-oxy group, alkylthio group, arylthio group, sulfonyl group, ureido group, carbamoyl group or sulfamoyl group. X represents a hydrogen atom or a group capable of being released upon reaction with an oxidation product of a developing agent. Examples thereof include a halogen atom, alkoxy group, aryloxy group, acyloxy group, sulfonyloxy group, alkylthio group, arylthio group. Of these, a halogen atom is more preferable and a chlorine atom is still more preferable. Examples of couplers represented by formula (2) and (3) are shown below.

MCP-1
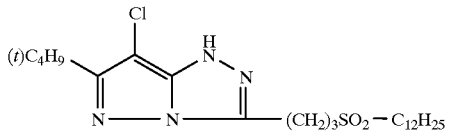
MCP-2
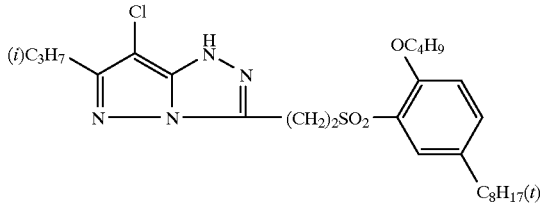
MCP-3
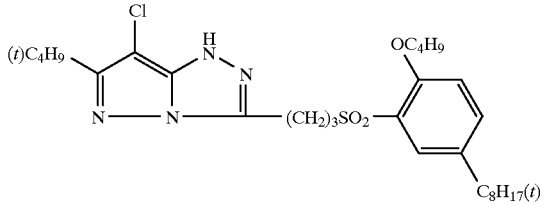
MCP-4
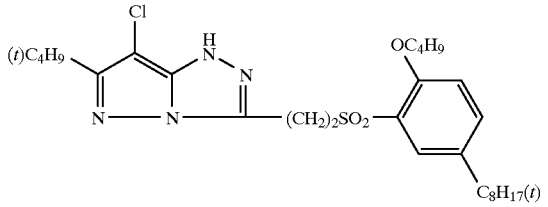
MCP-5
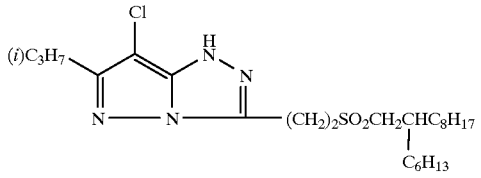
MCP-6
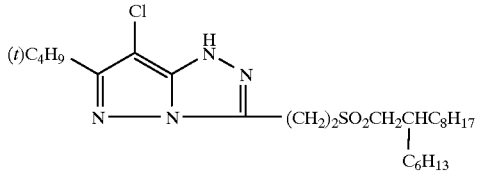
MCP-7
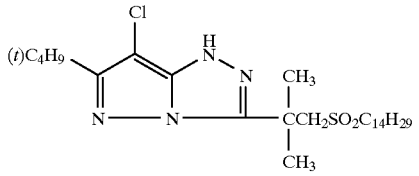
MCP-8
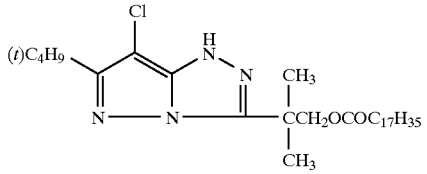

-continued
MCP-9
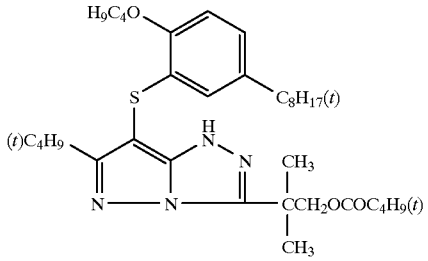
MCP-10
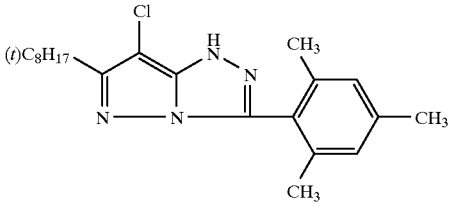
MCP-11
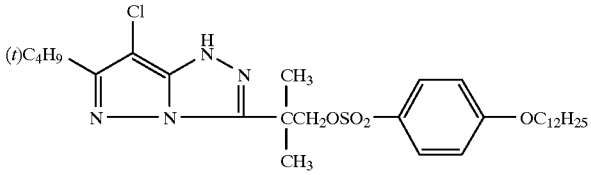
MCP-12
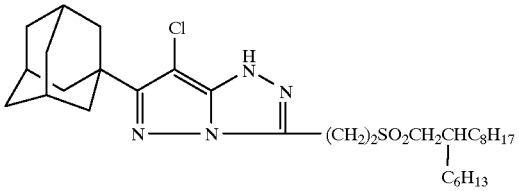
MCP-13
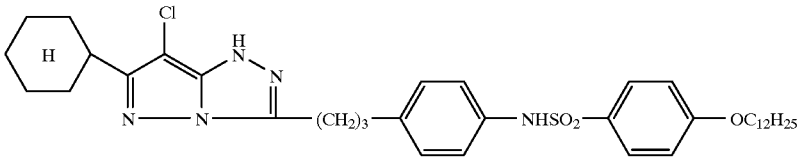
MCP-14
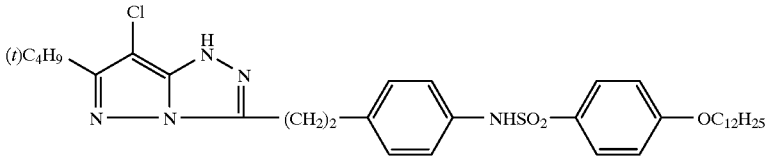
MCP-15
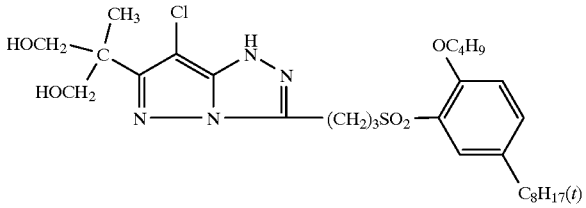

-continued
MCP-16
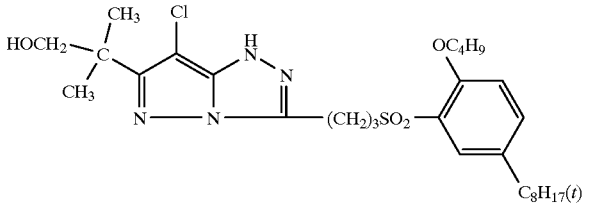
MCP-17
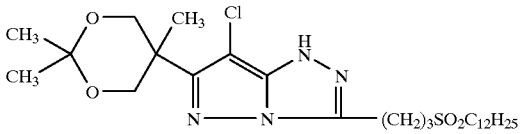
MCP-18
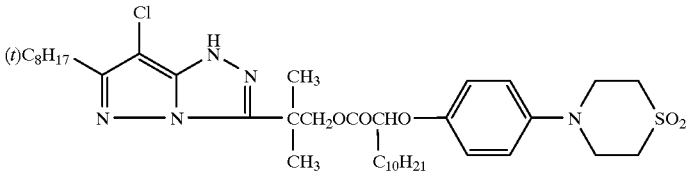
MCP-19
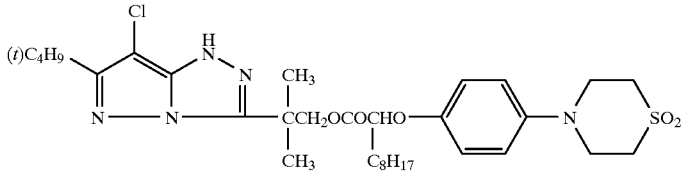
MCP-20
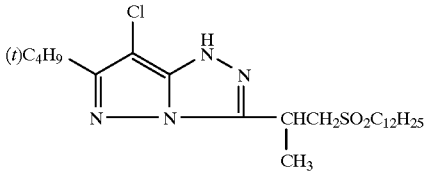
MCP-21
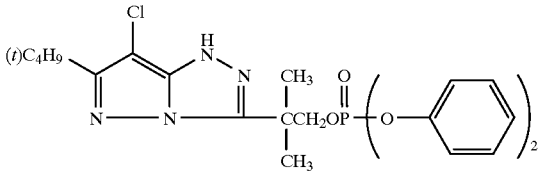
MCP-22
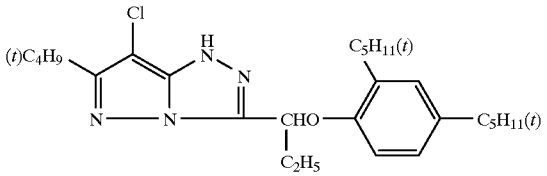
MCP-23
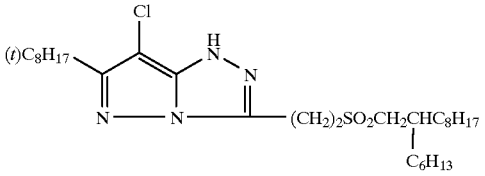

-continued
MCP-24
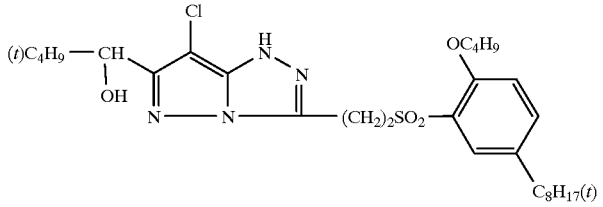
MCP-25
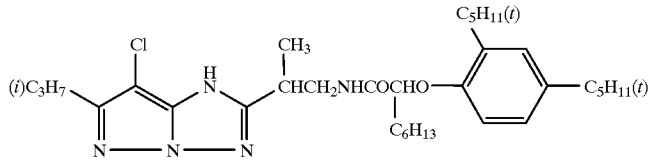
MCP-26
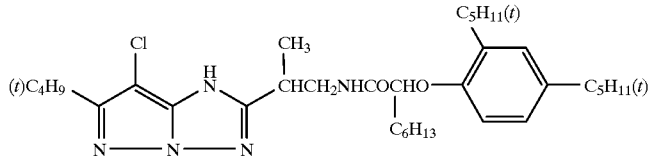
MCP-27
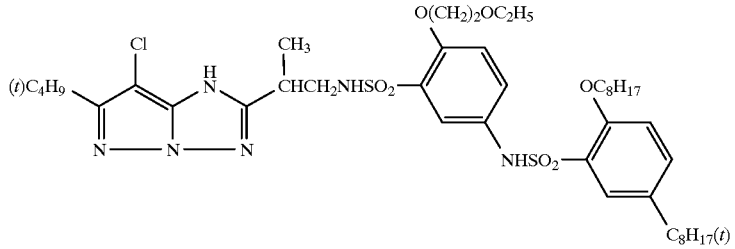
MCP-28
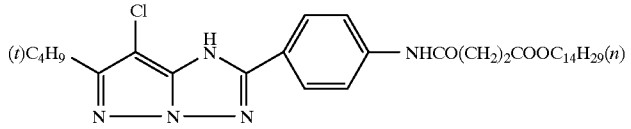
MCP-29
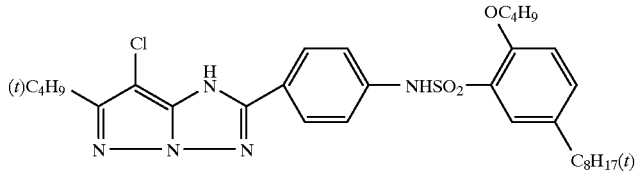
MCP-30
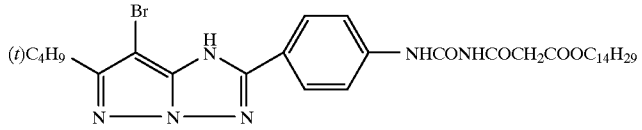
MCP-31
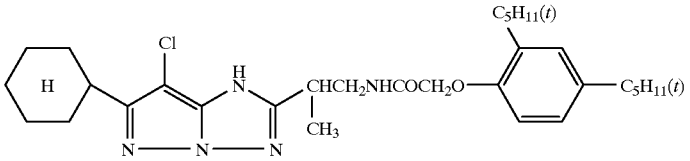

-continued

MCP-32

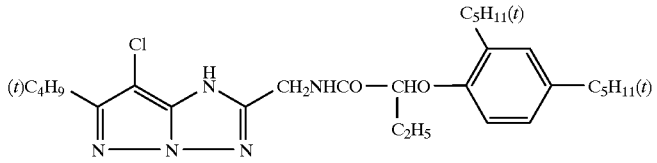

Examples of yellow couplers preferably used in the photographic material employed in the invention include couplers represented by formula (Y-I) described in JP-A 4-114154 at page 3, right upper column. A coupler which has an alkoxy group as RY1 of formula (Y-I), or couplers represented by formula [I] described in JP-A 6-67388 is preferable in terms of preferred reproduction of yellow tone. More preferred compounds are those represented by formula [Y-I] described in JP-A 4-81847 at pages 1 and 11 to 17.

As a coupler used in the photographic material relating to the invention is preferably employed a so-called two-equivalent coupler in which 1 mol of an oxidized developing agent is needed to stoichiometrically form 1 mol of a dye from 1 mol of the coupler, in terms of capability of shortening an amplified-developing time.

In cases where using an oil-in-water type emulsion-dispersing method to incorporate a coupler or other organic compounds into a photographic material, a coupler is dissolved in a high boiling solvent, optionally in combination with a low boiling and/or water-soluble organic solvent, and further dispersed in a hydrophilic colloid such as a gelatin aqueous solution using a surfactant. The high boiling solvent used for dissolving and dispersing a coupler preferably has a dielectric constant of 3.5 to 7.0. Two or more high boiling solvents can be employed in combination.

Alternatively, a water-insoluble and organic solvent-soluble polymeric compound is dissolved in combination with a high boiling solvent, and optionally a low boiling solvent; and then dispersed in a hydrophilic colloid such as a gelatin aqueous solution using a surfactant and by various dispersing means.

In the invention, to obtain a color image with superir color reproducibility and without deterioration of whiteness, at least one of component layers of the photographic material, including a silver halide emulsion layer and a light insensitive hydrophilic colloidal layer, preferably contains a compound represented by the following formula (1):

Formula (1)

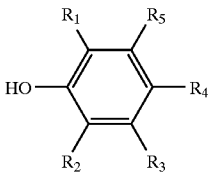

In the formula, $R_1$ represents a tertiary alkyl group (e.g., t-butyl, t-pentyl, t-octyl) and preferably a t-butyl group. $R_2$ represents a primary or secondary alkyl group (e.g., methyl, ethyl isopropyl) and preferably a methyl group, provided that $R_2$ may be substituted by a substituent, but is not substituted by a phenyl group; $R_3$, $R_4$ and $R_5$ independently represent an alkyl group (e.g., methyl, ethyl, butyl, dodecyl), an alkoxy group (e.g., 2-ethylhexyloxy), a phenoxy group [e.g., 4-(2-ethylhexyl)phenoxy, 4-dodecyl-phenoxy], an alkoxycarbonyl group (e.g., ethoxycarbonyl), phenoxycarbonyl group (e.g., 2,4-di-t-butylphenoxycarbonyl) or a phenylthio group (e.g., 3-t-butyl-4-hydroxy-5-methylphenylthio).

$R_1$ and $R_5$ may be substituted by a substituent. The compound represented by formula (1) is one not containing a primary, secondary or tertiary amino group or acylamino group; and preferably one not containing a primary, secondary or tertiary amino group. $R_4$ is preferably an alkyl group and more preferably a group having a linkage group represented by the following formula:

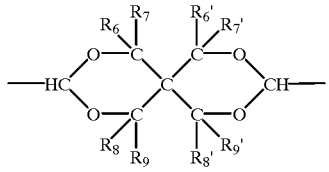

wherein $R_6$, $R_6'$, $R_7$, $R_7'$, $R_8$, $R_8'$, $R_9$, and $R_9'$ independently represent a hydrogen atom, an alkyl group, or a phenyl group. Of the compounds represented by formula (1), a compound represented by formula (1A) or (1B) is preferred.

Formula (1A)

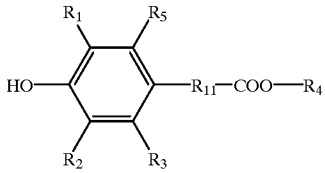

Formula (1B)

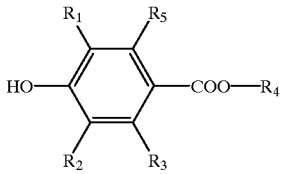

wherein $R_1$, $R_2$, $R_3$, $R_4$ and $R_5$ each are the same as defined in formula (1); and $R_{11}$ represents an alkylene group (e.g., ethylene, isobutylene). Of compounds represented by formulas (1A) and (1B) is preferred a compound represented by formula (1B). Exemplary examples of the compounds represented by formula (1) are shown below.

1-1

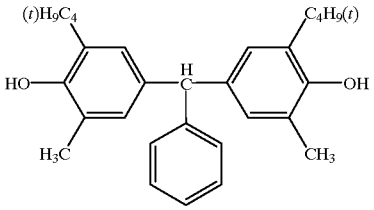

1-2

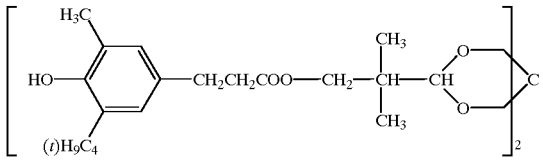

1-3

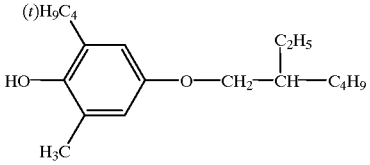

1-4

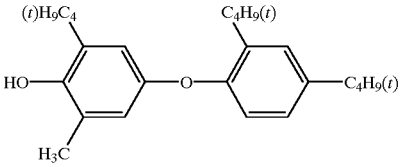

1-5

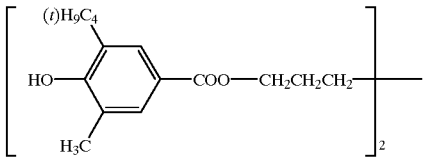

1-6

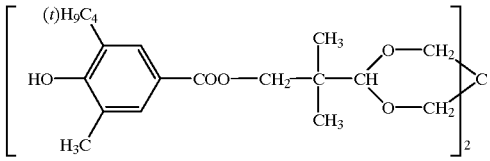

1-7

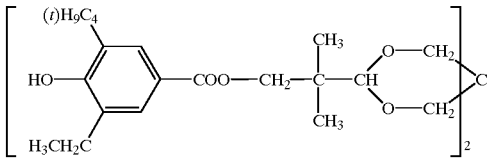

1-8

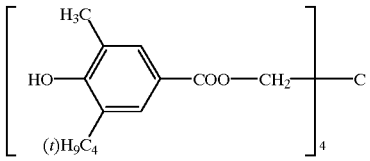

In the invention, at least one of component layers of the photographic material (including a silver halide emulsion layer and a light insensitive hydrophilic colloidal layer) preferably contains a aliphatic alcohol. Herein, the aliphatic alcohol refers to a compound comprising an alkyl group substituted by at least one hydroxy group, in which the alkyl group may be further substituted by another substituent (e.g., phenoxy, alkoxy, alkoxycarbonyl). The total number of carbon atoms contained in the aliphatic alcohol compound is preferably 20 to 50 and more preferably 25 to 40. The compound preferably contains two or more hydroxy groups.

Exemplary examples of the aliphatic alcohols are shown below.

A-1

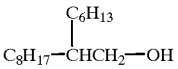

A-2

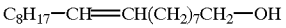

A-3

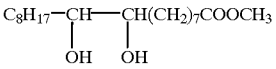

A-4

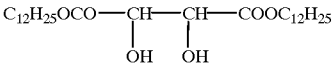

A-5

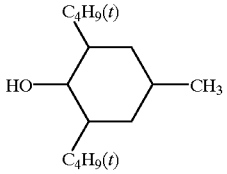

A-6

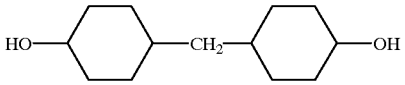

A-7

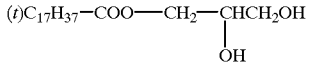

A-8

Sorbitan sesquioleate

A-9

Sorbitan trioleate

A-10

Glycerin-monooleate

A-11

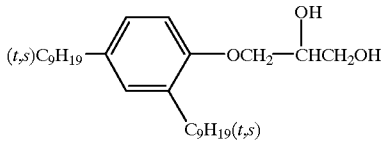

A-12

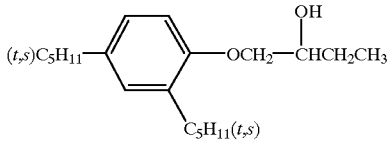

Further, at least one of the component layers preferably contains a compound represented by the following formula (4):

Formula (4)

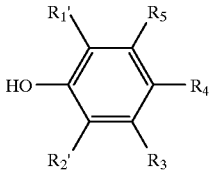

In the formula, $R_1'$ and $R_2'$ independently represent a primary, sendary or tertiary alkyl group (e.g., methyl, ethyl, isopropyl, t-butyl, etc.). $R_3$, $R_4$ and $R_5$ each have the same definition as in in Formula (1). $R_1'$, $R_2'$ and $R_3$ are preferably an alkyl group. More preferable is a compound with $R_1'$ of a tertiary alkyl group. These groups, $R_1'$ to $R_5$ each may be substituted.

Exemplary examples of the compound represented by Formula (4) are shown below.

4-1

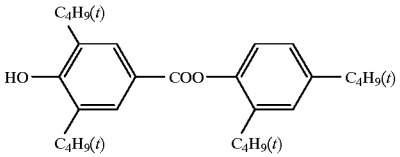

4-2

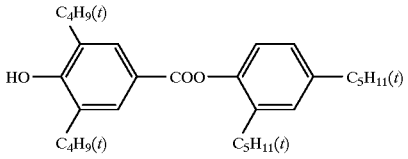

4-3

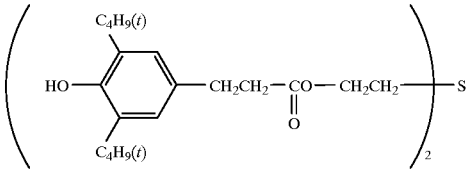

4-4

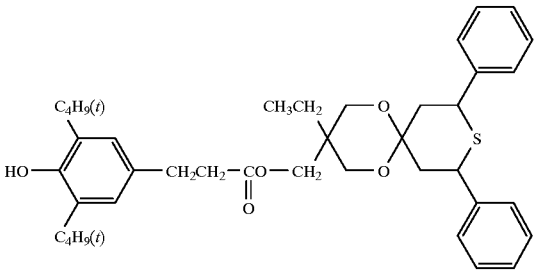

4-5

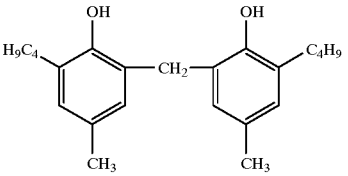

-continued 4-6

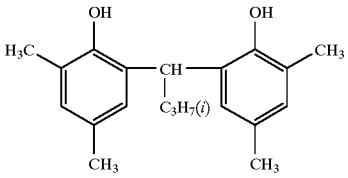

In the invention, a phenol compound (except for 2,6-dialkylphenol compounds) is containd preferably in an amount of 0.20 to 0.60 g per $m^2$ of photographic material. The phenol compound is one having at least one hydroxy group on the benzene ring, which may be substituted by other substituent (e.g., alkyl, alkoxy, alkoxycarbonyl, phenyl), provided that 2,6-dialkylphenol compounds are excluded. Examples thereof are shown below.

B-1

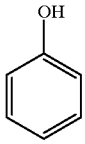

B-2

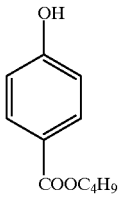

B-3

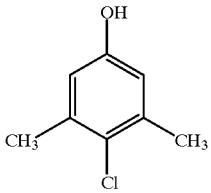

As a surfactant used for dispersing a photographic adjuvant or adjusting surface tension at the time of coating are preferably employed compounds having a hydrophobic group with 8 to 30 carbon atoms and a sulfonic acid group or its salt. A surfactant, an alkyl group of which is fluorine-substituted, is also preferably employed. The dispersing solution is conventionally added into a coating solution containing a silver halide emulsion. A period of time until added into the coating solution after dispersing, or until coated after adding into the coating solution is the shorter, is the more preferable. It is preferably within 10 hrs. more preferably 3 hrs. and furthermore preferably 20 min.

A compound (d-11) described in JP-A 4-114154 at page 9, left lower column and a compound (A'-1) described in the same at page 10, left lower column are also employed for allowing the absorption wavelengths of a dye to shift. Besides can also be employed a compound capable of releasing a fluorescent dye described in U.S. Pat. No. 4,774,187.

A compound capable of reacting with an oxidized developing agent is preferably incorporated into a layer between light sensitive layers to prevent color stain or into a silver halide emulsion layer to improve fogging. For the purpose thereof are preferably employed hydroquinone derivatives and more preferably dialkylhydroquinones such as 2,5-di-t-octylhydroquinone.

A UV absorbent is preferably incorporated into the photographic material to prevent static fogging or improve light fastness of dye images. Examples of preferred UV absorbents include benzotriazoles, more preferably, a compound represented by formula III-3 described in JP-A1-250944, a compound represented by formula III described in JP-A 64-66646, compounds, UV-1L to UV-27L described in JP-A 63-187240, a compound represented by formula I described in JP-A 4-1633 and a compound represented by formula (I) or (II) described in JP-A 5-165144.

A silver halide emulsion used in the invention may be any halide composition of silver chloride, silver bromide, silver chlorobromide, silver iodobromide, silver iodochlorobromide and silver iodochloride. Of these, a high chloride containing silver halide emulsion containing 80 mol % or more chloride can achieve effects of the invention without reduction of the maximum density due to restraining of amplification development and is preferable. There is more preferably employed a silver halide emulsion containing 90 mol % or more chloride and furthermore preferably 95 to 99.9 mol % chloride.

There is also preferably employed a silver halide emulsion comprised of silver halide grains containing a high bromide within the grain. In this case, silver halide grains may be core/shell grains having a layered structure or grain with so-called epitaxial deposition. The halide composition may be varied continuously or discontinuously. A high bromide is preferably localized at the corner of the grain.

Heavy metal ions can be occluded in silver halide emulsion grains for enhancement of various photographic performance. There can be used heavy metal ions of 8 to 10 groups metals such as iron, iridium, platinum, palladium, nickel, rhodium, osmium, ruthenium and cobalt; 12 group transition metals such as cadmium, zinc and mercury; and lead, rhenium, molybdenum, tungsten, gallium, chromium. Of these are preferred ions of metal of iron, iridium, platinum, ruthenium, gallium or osmium. The metal ions can be incorporated in the form of a salt or a complex salt. In cases when the metal ions form a complex, a cyanide ion, thiocyanate ion, isothiocyanate ion, cyanate ion, chloride ion, bromide ion, iodide ion, carbonyl, and ammonium are used as a ligand. Of these are preferred a cyanide ion, thiocyanate ion, isothiocyanate ion, chloride ion and bromide ion.

To allow the heavy metal ions to be occluded within the grain, a compound of the metal can be added at any step before or during formation of silver halide grains, or after grain formation and during physical ripening. It is preferred that the metal compound be dissolved with a halide salt and added continuously over a period of the whole or a part of grain formation. The metal ions is preferably added $1\times10^{-9}$ to $1\times10^{-2}$ mol and more, preferably $1\times10^{-8}$ to $5\times10^{-5}$ mol per mol of silver halide.

Silver halide grains usable in the invention may be any form. One of preferred forms is cubic grains having (100) crystal faces. Silver halide grains in an octahedral, tetradecahedral or dodecahedral form can be prepared according to the method described in U.S. Pat. No. 4,183,756 and 4,225,666, JP-A 55-26589, JP-B 55-42737 (herein the term, "JP-B" means an examined and published Japanese Patent) and J. Photogr. Sci. 21 39 (1973). Further, grains having twin plane(s) can be employed.

Monodisperse silver halide grains having a single form are preferred in the invention. Two or more monodisperse silver halide emulsions can be incorporated into a single layer. Herein, the monodisperse silver halide emulsion is referred to as one having not more than 0.22 of a coefficient of variation indicating a width of grain size distribution. A silver halide emulsion with a coefficient of variation of not more than 0.15 is more preferred. The coefficient of variation is defined as follows:

$$\text{Coefficient of variation}=S/R$$

where S represents a standard deviation of grain size distribution and R represents an average grain size. The grain size of a silver halide emulsion used in the invention is not limited, but is preferably 0.1 to 1.2 $\mu$m and more preferably 0.2 to 1.0 $\mu$m, in terms of rapid processability, sensitivity and other photographic performance. The size of silver halide grains can be determined by methods known in the photographic art. Representative methods include those described in Loveland, "Analysis of Grain Sizes")A.S.T.M. Symposium on Light microscopy, pages 94-122, 1955) and Mees & James, "Theory of Photographic Process" 3rd ed. chapter 2, (Macmillan, 1966).

There can be employed a variety of apparatuses and methods for preparing silver halide emulsions, which are generally known in the art. The silver halide can be prepared according to any of acidic precipitation, neutral precipitation and ammoniacal precipitation. Silver halide grains can formed through a single process, or through forming seed grains and growing them. A process for preparing seed grains and a growing process thereof may be the same with or different from each other.

Normal precipitation, reverse precipitation, double jet precipitation or a combination thereof is applicable as a reaction mode of a silver salt and halide salt, and the double jet precipitation is preferred. As one mode of the double jet precipitation is applicable a pAg-controlled double jet method described in JP-A 54-48521. There can be employed a apparatus for supplying a silver salt aqueous solution and a halide aqueous solution through an adding apparatus provided in a reaction mother liquor, as described in JP-A 57-92523 and 57-92524; an apparatus for adding silver salt and halide solutions with continuously varying the concentration thereof, as described in German Patent 2,921,164; and an apparatus for forming grains in which a reaction mother liquor is taken out from the reaction vessel and concentrated by ultra-filtration to keep constant the distance between silver halide grains.

Solvents for silver halide such as thioethers are optionally employed. A compound containing a mercapto group, nitrogen containing heterocyclic compound or a compound such as a sensitizing dye can also be added at the time of forming silver halide grains or after completion thereof.

So-called tabular silver halide grains are preferably employed to control the contrast balance. There are known high chloride tabular grains having {111} major faces and those having {100} major faces, and the tabular grain having {100} major faces are preferred in terms of stability of the grain form.

A silver halide emulsion can be chemically sensitized by use of a gold compound or a chalcogen compound. Chalcogen sensitizers applicable to the silver halide emulsion used in the invention include a sulfur sensitizer, a selenium sensitizer and a tellurium sensitizer. Of these is preferred a sulfur sensitizer.

A antifoggant or a stabilizer known in the art are incorporated into the photographic material, for the purpose of preventing fog produced during the process of preparing the photographic material, reducing variation of photographic performance during storage or preventing fog produced in development. Examples of preferred compounds for the purpose incline compounds represented by formula (II) described in JP-A 2-146036 at page 7, lower column. These compounds are added in the step of preparing a silver halide emulsion, the chemical sensitization step or the course of from completion of chemical sensitization to preparation of a coating solution.

In the photographic material used in the invention, silver halide grains are adequate to form developed silver which acts as a catalyst in the amplification development. Accordingly, the quantity of silver halide grains can be greatly reduced, as compared to conventional color development, in which an oxidized developing agent, necessary for coupling with a coupler, is formed by redox reaction between silver halide and a developing agent. In this case, the amount of silver halide, is preferably not more than 60 mg/m$^2$, based on silver, for each color image forming layer, and more preferably not more than 30 mg/m$^2$. The less amount of silver halide generally tends to result in poor tone reproduction, therefore, effects of amplified development in the invention become useful. The silver halide amount of the color image forming layer farthest from the support is preferably 5 to 60 mg/m$^2$, on the basis of silver. Specifically, when the silver amount is 10 to 35 mg/m$^2$, the effects of the invention becomes more marked and therefore it is more preferable. In cases where the photographic material is provided with three color image forming layers comprising a yellow image forming layer, a magenta image forming layer and a cyan image forming layer, the silver amount of the image forming layer farthest from the support is preferably 5 to 25% of the total silver amount to display effects of the invention.

There are employed dyes having absorption at various wavelengths for anti-irradiation and anti-halation in the photographic material relating to the invention. A variety of dyes known in the art can be employed, including dyes having absorption in the visible range described in JP-A 3-251840 at page 308, AI-1 to 11, and JP-A 6-3770; infrared absorbing dyes described in JP-A 1-280750 at page 2, left lower column, formula (I), (II) and (III). These dyes do not adversely affect photographic characteristics of a silver halide emulsion and there is no stain due to residual dyes. For the purpose of improving sharpness, the dye is preferably added in an amount that gives a reflection density at 680 nm of not less than 0.7 and more preferably not less than 0.8.

Fluorescent brightening agents are also incorporated into the photographic material to improve whiteness. Examples of preferred compounds include those represented by formula II described in JP-A 2-232652.

The photographic material used in the invention comprises layer(s) containing silver halide emulsion(s) which are spectrally sensitized in the wavelength region of 400 to 900 nm, in combination with a yellow coupler, a magenta coupler and a cyan coupler. The silver halide emulsion contains one or more kinds of sensitizing dyes, singly or in combination thereof. In the silver halide emulsions used in the invention can be employed a variety of spectral-sensitizing dyes known in the art. Compounds BS-1 to 8 described in JP-A 3-251840 at page 28 are preferably employed as a blue-sensitive sensitizing dye. Compounds GS-1 to 5 described in JP-A 3-251840 at page 28 are preferably employed as a green-sensitive sensitizing dye. Compounds RS-1 to 8 described in JP-A 3-251840 at page 29 are preferably employed as a red-sensitive sensitizing dye. In cases where exposed to infra-red ray with a semiconductor laser, infrared-sensitive sensitizing dyes are employed. Compounds IRS-1 to 11 described in JP-A 4-285950 at pages 6-8 are preferably employed as a blue-sensitive sensitizing dye. Supersensitizers SS-1 to SS-9 described in JP-A 4-285950 at pages 8-9 and compounds S-1 to S-17 described in JP-A 5-66515 at pages 5-17 are preferably included, in combination with these blue-sensitive, green-sensitive and red-sensitive sensitizing dyes.

The sensitizing dye is added at any time during the course of silver halide grain formation to completion of chemical sensitization. The sensitizing dye is incorporated through solution in water-miscible organic solvents such as methanol, ethanol, fluorinated alcohol, acetone and dimethylformamide or water, or in the form of a solid particle dispersion.

In the photographic materials used in the invention is advantageously employed gelatin as a binder. Furthermore, there can be optionally employed other hydrophilic colloidal materials, such as gelatin derivatives, graft polymers of gelatin with other polymers, proteins other than gelatin, saccharide derivatives, cellulose derivatives and synthetic hydrophilic polymeric materials. Avinylsulfone type hardening agent or a chlorotriazine type hardening agent is employed as a hardener of the binder, and compounds described in JP-A 61-249054 and 61-245153 are preferably employed. An antiseptic or antimold described in JP-A 3-157646 is preferably incorporated into a hydrophilic colloid layer to prevent the propagation of bacteria and mold which adversely affect photographic performance and storage stability of images. A lubricant or a matting agent is also preferably incorporated to improve surface physical properties of raw or processed photographic materials.

A variety of supports are employed in the photographic material used in the invention, including paper coated with polyethylene or polyethylene terephthalate, paper support made from natural pulp or synthetic pulp, polyvinyl chloride sheet, polypropylene or polyethylene terephthalate supports which may contain a white pigment, and baryta paper. Of these supports a paper support coated, on both sides, with water-proof resin layer. As the water-proof resin are preferably employed polyethylene, ethylene terephthalate and a copolymer thereof. Inorganic and/or organic white pigments are employed, and inorganic white pigments are preferably employed. Supports having a center face roughness (Sra) of 0.15 nm or less (preferably, 0.12 nm or less) are preferably employed in terms of glossiness. Trace amounts of a blueing agent or reddening agent such as ultramarine or oil-soluble dyes are incorporated in a water-proof resin layer containing a white pigment or hydrophilic layer(s) of a reflection support to adjust the balance of spectral reflection density in a white portion of processed materials and improve its whiteness. The surface of the support may be optionally subjected to corona discharge, UV light exposure or flame treatment and further thereon, directly or through a sublayer (i.e., one or more sublayer for making improvements in surface properties of the support, such as adhesion property, antistatic property, dimensional stability, friction resistance, hardness, anti halation and/or other characteristics), are coated component layers of the photographic material relating to the invention. In coating of the photographic material, a thickening agent may be employed to enhance coatability of a coating solution. As a coating method are useful extrusion coating and curtain coating, in which two or more layers are simultaneously coated.

To form photographic images using a photographic material relating to the invention, an image recorded on the negative can optically be formed on a photographic material to be printed. Alternatively, the image is converted to digital information to form the image on a CRT (anode ray tube), and the resulting image can be formed on a photographic material to be printed by projecting or scanning with varying the intensity and/or exposing time of laser light, based on the digital information.

The image forming method according to the invention is preferably applied to photographic materials used for forming a directly observable image, including a color print paper, color reversal paper. direct positive material, display photographic material and a photographic material used for color proof. Specifically, the image forming method is preferably applied to photographic materials having a reflection support.

The amplification development will be further explained as below. In the invention the amplification development or amplified developing treatment is defined as a process in which latent images formed by exposing a photographic material to light, is developed with a color or black-and-white developing agent to form developed silver images and dye images can be formed or amplified employing chemical reaction catalyzed by the developed silver. Concretely, for example, an oxidized developing agent produced by developed silver-catalyzed redox reaction between the developing agent and an oxidizing agent, reacts with a coupler through coupling reaction to form a dye image.

Examples of the oxidizing agent include hydrogen peroxide, a compound capable of providing hydrogen peroxide such as an adduct of hydrogen peroxide, peroxo compounds such as a peroxoborate and peroxocarbonate, cobalt (III) complexes such as cobalt hexaamine complex, halous acids such as chlorous acid, and periodic acid. Of these oxidizing agents is preferably employed hydrogen peroxide, in terms of high amplification effects and reduced environmental impact.

A combination of an aromatic primary amine developing agent and hydrogen peroxide is preferably employed in the amplification development in the invention. Examples of the aromatic primary amine developing agents includeN,N-diethyl-p-phenylendiamine2-amino-5-diethylaminotoluene, 2-amino-5-(N-ethyl-N-laurylamino)toluene, 4-(N-ethyl-N-(β-hydroxyethyl)amino)-aniline, 2-methyl-4-(N-ethyl-N-(β-hydroxyethyl)amino)aniline, 4-amino-3-methyl-N-ethyl-N-(β-methanesulfoneamido)-ethyl)aniline, N-(2-amino-5-diethylaminophenylethyl)-methanesulfonamide, N,N-dimethyl-p-phenylenediamine, 4-amino-3-methyl-N-ethyl-N-metoxyethylaniline, 4-amino-3-methyl-N-ethyl-N-(β-ethoxyethyl)aniline, 4-amino-3-methyl-N-ethyl-N-(γ-hydroxypropyl)aniline, 4-amino-3-methyl-N-ethyl-N-(4-hydroxybutyl)aniline, 4-amino-3-methyl--N-ethyl-N-(β-hydroxypropyl)aniline, 4-amino-3-methyl-N-ethyl-N-(2-hydroxy(1-methyl)ethyl)aniline, 4-amino-3-ethyl-N-methyl-N-(γ-hydroxypropyl)aniline; and various aromatic primary amine developing agents described in JP-A 3-345142, 4-11255, 4-45440, 4-226452, and 4-371948. Besides the aromatic primary amine developing agents, sulfophenylhydrazine or carbonylhydrazine type developing agents are also preferably employed, as described in European Patent 565,165, 572,054 and 593,110, JP-A 8-202002, 8-227131 and 8-234390. Of these are preferred 4-amino-3-methyl-N-ethyl-N-(β-methanesulfoneamido)ethyl)aniline and 4-amino-3-methyl-N-ethyl-N-(γ-hydroxypropyl) aniline, 4-amino-3-methyl-N-ethyl-N-(4-hydroxybutyl) aniline, in terms of being not only high inventive effects but also high light stability of the dye image.

According to the invention, a processing solution containing a color developing agent together with an oxidizing agent used for amplification can supplied to the photographic material. Alternatively, a processing solution containing the color developing agent and a solution containing the oxidizing agent are separately prepared and both solutions each can be supplied to the photographic material.

As an amplified developing method are disclosed a technique in which a developing agent is concurrently present with an oxidizing agent in a processing bath (hereinafter, a processing solution containing a developing agent together with oxidizing agent is denoted as "developing/amplifying solution"), formation of developed silver acting as catalyst and subsequent amplification development is carried out in the same bath, as described in JP-A 52-13335, 55-127555 and 61-77851; a technique in which a developing bath containing a developing agent is separated from an amplifying bath containing an oxidizing agent and after developed silver is formed in the developing bath, the developing agent is brought into the amplifying bath to carry out amplification development, as described in JP-A 5-216192 and 5-346647; and a technique in which after processed in a bath containing a developing agent to form developed silver, amplification development is carried out in a processing bath containing a developing agent and an oxidizing agent together, as described in JP-A 61-88259 and 7-77788. Furthermore, as a processing method without the use of a processing bath is disclosed a technique in which a developing solution or amplifying solution is directly sprayed onto a silver halide photographic material, as described in JP-A 61-80150.

In cases where the developing bath is separated from the amplifying bath, the developing agent is contained, in the developing bath, in an amount of 0.2 to 50 g/l and preferably 1 to 25 g/l. Hydrogen peroxide (30% aqueous solution) is contained, in the amplifying bath, in an amount of 0.1 to 100 ml/l. In cases where processed in one bath of combined developing and amplifying bath, the developing agent is contained, in the developing/amplifying solution, in an amount of 0.5 to 15 g/l and preferably 1 to 7 g/l; and hydrogen peroxide (30% aqueous solution) is contained in amount of 0.1 to 30 ml/l and preferably 1 to 5 ml/l.

The amplified developing temperature is preferably 20 to 60° C. The higher processing temperature is preferred for shortening the processing time, but not so high temperature is preferred in terms of process stability. In light thereof, processing at a temperature of 25 to 55° C. are preferable. The amplified developing time, depending of a processing temperature and activity of a processing solution, is preferably within 180 sec. and more preferably within 90 sec.

In addition to the color developing agent and oxidizing agent, developer composing compounds known in the art can be incorporated in the developing solution, amplifying solution and developing/amplifying solution. There are conventionally used an alkaline agent for pH-buffering, a development retarder such as chloride ion and benzotriazoles, preservatives and chelating agents. Compounds known as a pH-buffering agent can be used and specifically, a buffer comprised of potassium (or sodium) carbonate/ potassium (or sodium) hydrogen carbonate is preferable in terms of cost and environmental protection. The pH in the process of amplification development is not limitative, but preferably less than 10.3 and more preferably not more than 10.0.

In the image forming method according to the invention, photographic materials, after color-developed, may be optionally subjected to bleaching and fixing. The bleaching and fixing may be carried out currently. After fixing, washing is conventionally carried out. Stabilizing may be conducted in place of washing. As a processing apparatus used in the invention is applicable a roller transport type processor in which a photographic material is transported with being nipped by rollers and an endless belt type processor in which a photographic material is transported with being fixed in a belt. Further thereto are also employed a method in which a processing solution supplied to a slit-formed processing bath and a photographic material is transported therethrough, a spraying method, a web processing method by contact with a carrier impregnated with a processing solution and a method by use of viscous processing solution.

EXAMPLES

The present invention will be further explained based on examples, but embodiments of the invention are not limited to these.

Example 1

Preparation of blue-sensitive silver halide emulsion (Em-B1):

To 1 liter of aqueous 2% gelatin solution kept at 40° C. were simultaneously added the following solutions (Solutions A1 and B1) while being maintained at a pAg of 7.3 and pH of 3.0, and further thereto were added Solutions C1 and D1 , while being maintained at a pAg of 8.0 and pH of 5.5. The pAg was controlled by the method described in JP-A 59-45437, and the pH was adjusted using aqueous sulfuric acid or sodium hydroxide solution.

| | |
|---|---|
| Solution A1 | |
| Sodium chloride | 3.42 g |
| Potassium bromide | 0.03 g |
| Water to make | 200 ml |
| Solution B1 | |
| Silver nitrate | 10 g |
| Water to make | 200 ml |
| Solution C1 | |
| Sodium chloride | 102.7 g |
| Potassium hexachloroiridium (IV) | $4 \times 10^{-8}$ mol |
| Potassium hexacyano-iron (II) | $2 \times 10^{-5}$ mol |
| Potassium bromide | 1.0 g |
| Water to make | 600 ml |
| Solution D1 | |
| Silver nitrate | 300 g |
| Water to make | 600 ml |

After completing the addition, the resulting emulsion was desalted using a 5% aqueous solution of Demol N (produced by Kao-Atlas) and aqueous 20% magnesium sulfate solution, and redispersed in a gelatin aqueous solution to obtain a monodisperse cubic grain emulsion (EMP-1A) having an average grain size of 0.71 μm, a coefficient of variation of grain size of 0.07 and a chloride content of 99.5 mol %. Further, a monodisperse cubic grain emulsion (EMP-1B) having an average grain size of 0.64 μm, a coefficient of variation of grain size of 0.07 and a chloride content of 99.5 mol % was prepared in the same manner as in preparation of EMP-1A, except that an adding time of Solutions A1 and B1, and that of C1 and D1 were respectively varied.

The emulsion, EMP-1A was chemically sensitized at 60° C. using the following compounds. The emulsion, EMP-1B was also optimally chemical-sensitized in a similar manner, and then sensitized EMP-1A and EMP-1B were blended in a ratio of 1:1 based on the silver amount to obtain a blue-sensitive silver halide emulsion (Em-B1).

| | |
|---|---|
| Sodium thiosulfate | 0.8 mg/mol AgX |
| Chloroauric acid | 0.5 mg/mol AgX |
| Stabilizer STAB-1 | $3 \times 10^{-4}$ mol/mol AgX |
| Stabilizer STAB-2 | $3 \times 10^{-4}$ mol/mol AgX |
| Stabilizer STAB-3 | $3 \times 10^{-4}$ mol/mol AgX |
| Sensitizing dye BS-1 | $4 \times 10^{-4}$ mol/mol AgX |
| Sensitizing dye BS-2 | $1 \times 10^{-4}$ mol/mol AgX |

STAB-1: 1-(3-Acetoamidophenyl)-5-mercaptotetrazole
STAB-2: 1-Phenyl-5-mercaptotetrazole
STAB-3: 1-(4-ethoxyphenyl)-5-mercaptotetrazole Preparation of red-sensitive silver halide emulsion (Em-R1)

Monodisperse cubic grain emulsions, EMP-21A having an average grain size of 0.40 μm and a chloride content of 99.5 mol % and EMP-21B having an average grain size of 0.38 μm and a chloride content of 99.5 mol % was prepared in the same manner as in preparation of EMP-1A, except that an adding time of Solutions A1 and B1, and that of C1 and D1 were respectively varied. The emulsion, EMP-21A was optimally chemical-sensitized at 60° C. using the following compounds. The emulsion, EMP-21B was also optimally chemical-sensitized in a similar manner, and then sensitized EMP-21A and EMP-21B emulsions were blended in a ratio of 1:1 based on the silver amount to obtain a blue-sensitive silver halide emulsion (Em-R1).

| | |
|---|---|
| Sodium thiosulfate | 1.8 mg/mol AgX |
| Chloroauric acid | 2.0 mg/mol AgX |
| Sensitizing dye RS-1 | $1 \times 10^{-4}$ mol/mol AgX |
| Sensitizing dye RS-2 | $1 \times 10^{-4}$ mol/mol AgX |
| SS-1 | $2 \times 10^{-3}$ mol/mol AgX |
| Stabilizer STAB-1 | $3 \times 10^{-4}$ mol/mol AgX |
| Stabilizer STAB-2 | $3 \times 10^{-4}$ mol/mol AgX |
| Stabilizer STAB-3 | $3 \times 10^{-4}$ mol/mol AgX |

BS-1

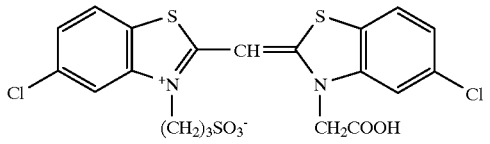

-continued

BS-2

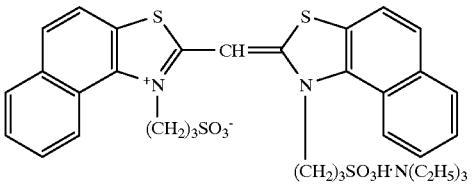

RS-1

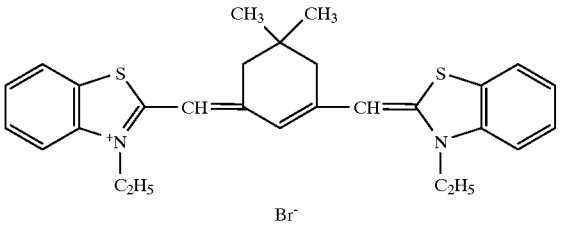

RS-2

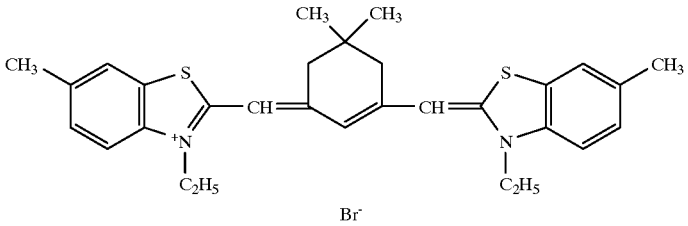

SS-1

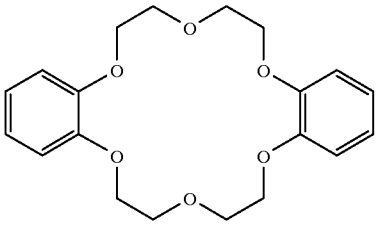

Preparation of silver halide photographic material (101)

There was prepared a paper support laminated, on paper with a weight of 180 g/m$^2$, with high density polyethylene, provided that the side to coat an emulsion layer was laminated with polyethylene melt containing surface-treated anatase type titanium oxide in an amount of 15% by weight. The reflection support was subjected to corona discharge and provided with a gelatin sublayer, and further thereon, the following component layers were provided to prepare a silver halide photographic material. Coating solutions each were prepared so as to have coating amounts as below. Hardeners (H-1) and (H-2) were added. There were also added surfactants, (SU-2) and (SU-3) to adjust surface tension. To each layer was further added (F-1) in an amount of 0.04 g/m$^2$.

| Layer | Constitution | Amount (g/m$^2$) |
|---|---|---|
| 4th layer (Protective layer) | Gelatin | 1.00 |
| | DIDP | 0.002 |
| | DBP | 0.002 |
| | Silicon dioxide | 0.003 |
| 3rd layer (Red-sensitive layer) | Gelatin | 1.30 |
| | Red-sensitive emulsion (Em-R1) | 0.013 |

-continued

| Layer | Constitution | Amount (g/m$^2$) |
|---|---|---|
| | Cyan coupler (C-4) | 0.13 |
| | Dye image stabilizer (ST-1) | 0.10 |
| | Antistaining agent (HQ-1) | 0.004 |
| | DBP | 0.10 |
| | DOP | 0.20 |
| 2nd layer (Interlayer) | Gelatin | 1.20 |
| | AI-3 | 0.01 |
| | Antistaining agent (HQ-2) | 0.03 |
| | Antistaining agent (HQ-3) | 0.03 |
| | Antistaining agent (HQ-4) | 0.05 |
| | Antistaining agent (HQ-5) | 0.23 |
| | DIDP | 0.04 |
| | DBP | 0.02 |
| | Brightening agent (W-1) | 0.10 |
| 1st layer (Blue-sensitive layer) | Gelatin | 1.20 |
| | Blue-sensitive Emulsion (Em-B1) | 0.033 |
| | Yellow coupler (Y-1) | 0.70 |
| | Dye image stabilizer (ST-1) | 0.10 |
| | Dye image stabilizer (ST-2) | 0.10 |
| | Dye image stabilizer (ST-5) | 0.10 |
| | Antistaining agent (HQ-1) | 0.01 |
| | Image stabilizer A | 0.15 |

-continued

| Layer | Constitution | Amount ($g/m^2$) |
|---|---|---|
| | DBP | 0.10 |
| | DNP | 0.05 |
| Support | Polyethylene-laminated paper | |

(The coating amount of silver halide was based on silver.)

Preparation of photographic materials (102 to 105)

Photographic materials 102 to 104 were prepared in the same manner as in photographic material 101, except that couplers used in the 1st and 3rd layers were varied as shown in Table 1. Further, photographic material 105 was prepared in the same manner as photographic material 102, except that the silver coating amount was changed to 0.033 $g/m^2$. Compounds employed are as follows.

SU-2: Di(2-ethylhexyl) sulfosuccinate sodium salt

SU-3: 2,2,3,3,4,4,5,5-Octafluoropentyl sulfosuccinate sodium salt

H-1: Tetrakis(vinylsulfonylmethyl)methane

H-2: 2,4-Dichloro-6-hydroxy-s-triazine sodium salt

DBP: Dibutyl phthalate

DIDP: Diisodecyl phthalate

DOP: Dioctyl phthalate

DNP: Dinonyl phthalate

HQ-1: 2,5-Di-t-octylhydroquinone

HQ-2: 2,5-Di-sec-dodecylhydroquinone

HQ-3: 2,5-Di-sec-tetradecylhydroquinone

HQ-4: 2,5-Di(1,1-dimethyl-4-hexyloxycarbonyl)butylhydroquinone

Image stabilizer A: p-t-Octylphenol

C-1

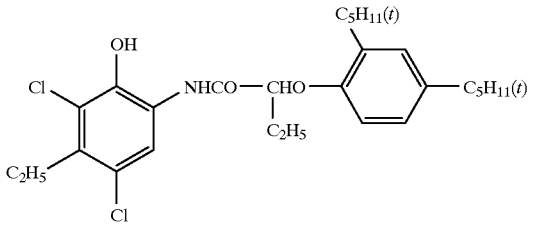

C-2

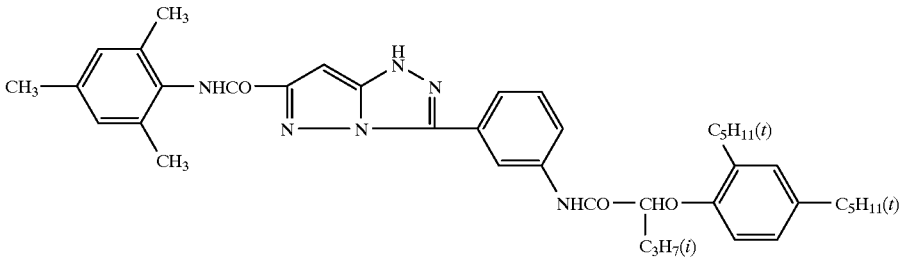

C-3

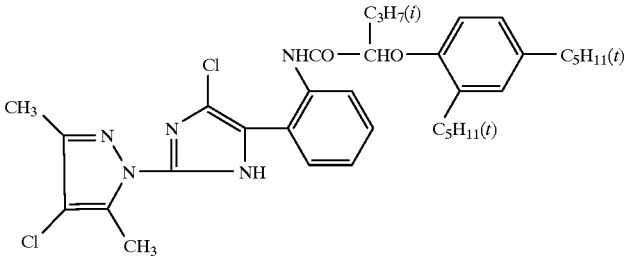

-continued
C-4
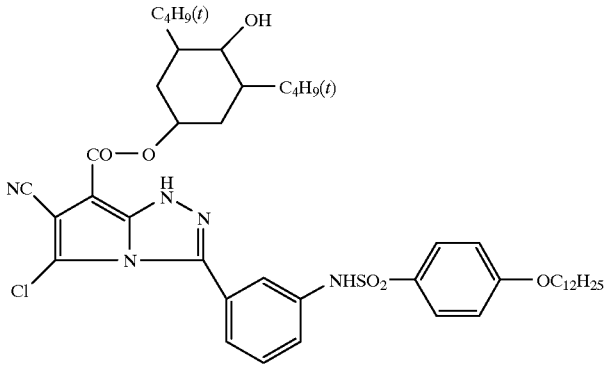
Y-1
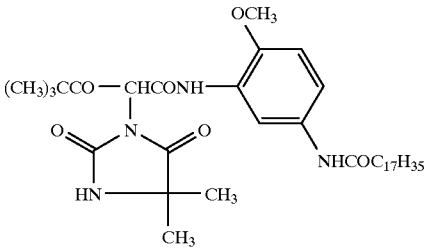
ST-1
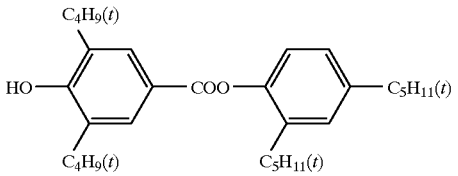
ST-2
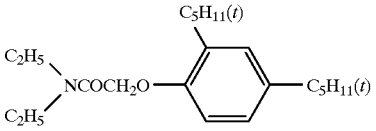
ST-5
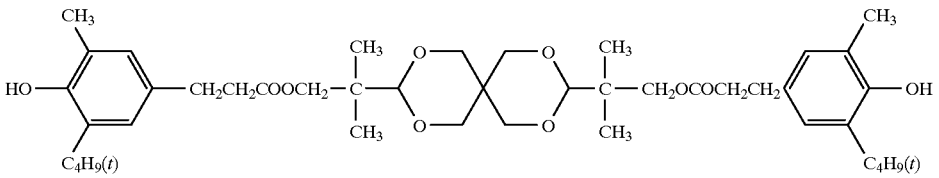
AI-3
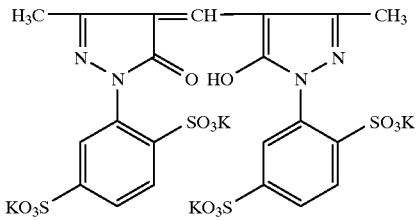

-continued

F-1

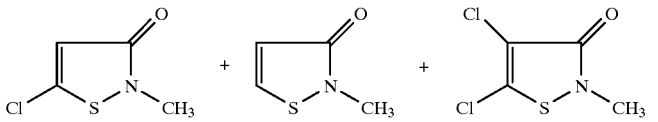

(50%) (46%) (4%) Molar ratio

Molar ratio (50:46:4)

W-1

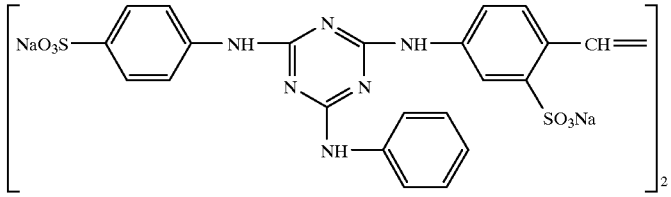

TABLE 1

| Sam- | 1st layer | | | 3rd layer | | | Re- |
|---|---|---|---|---|---|---|---|
| ple | Coupler | Content | $\epsilon(\times 10^4)$ | Coupler | Content | $\epsilon(\times 10^4)$ | mark |
| 101 | Y-1 | 0.70 | 1.5 | C-4 | 0.13 | 7.4 | Inv. |
| 102 | C-1 | 0.28 | 2.6 | Y-1 | 0.70 | 1.5 | Comp. |
| 103 | Y-1 | 0.70 | 1.5 | C-2 | 0.14 | 7.0 | Inv. |
| 104 | Y-1 | 0.70 | 1.5 | C-3 | 0.12 | 7.5 | Inv. |
| 105 | C-1 | 0.28 | 2.6 | Y-1 | 0.70 | 1.5 | Comp. |

Photographic material samples (101) to (105) each were exposed to white light or blue light for 0.5 sec. and subjected to amplification development. Processed photographic material samples were subjected to sensitometry using a densitometer PDA-65 (produced by Konica Corp.) to measure reflection densities based on blue light or red light. After sensitometry, each sample was treated with an aqueous solution of pronase (gelatin degradation enzyme) to remove the 3rd and 4th layers for observation of only images formed in the 1st layer, and was again subjected to sensitometry to measure reflection densities. Herein, a slope of a straight light connecting two points corresponding to densities 0.75 and 1.75 on a characteristic curve of color images formed in the 1st layer was defined as a contrast. A contrast at exposure to white light (denoted as γW) and contrast at exposure to monochromatic (blue) light (denoted as γS) was determined and each sample was evaluated with respect to stability of tone reproduction, based on a value of contrast balance (γW/γS). In cases where developability of the 1st layer is not affected by image formation of the 3rd layer, the contrast of the 1st layer was little affected by the 3rd layer, resulting in a value of (γW/γS) close to 1. The more become effects of color image formation in the 3rd layer on developability of the 1st layer, the farther a value of (γW/γS) is away from 1. Thus, this means unstable tone reproduction and is not desirable. Evaluation results are shown in Table 2, in which a maximum density (Dmax) and a minimum density (Dmin) are reflection densities measured before removing the 3rd and 4th layers of a sample exposed to white light.

Processing:

| Step | Temperature | Time |
|---|---|---|
| Amplified developing | 33.0 ± 0.5° C. | 60 or 80 sec. |
| Bleach-fixing | 35.0 ± 0.5° C. | 20 sec. |
| Stabilizing | 30 to 34° C. | 60 sec. |
| Drying | 60 to 80° C. | 30 sec. |

Composition of processing solutions is as follows.

| Amplified-developer (CDA-1) | |
|---|---|
| Water | 800 ml |
| Potassium bromide | 0.001 g |
| Potassium chloride | 0.35 g |
| N-Ethyl-N-(β-methanesulfonamidoethyl) -3-methyl-4-aminoaniline sulfate | 4.0 g |
| N,N-Diethylhydroxylamine | 4.7 g |
| Sodium diethylenetriaminepentaacetate | 2.0 g |
| 1-Hydroxyethylidene-1,1'-disulfonic acid | 0.35 g |
| Brightener (4,4'-Diaminostilbenedisulfonic acid derivative) | 2.0 g |
| Potassium carbonate | 20 g |
| Aqueous hydrogen peroxide (5.99%) | 25 ml |

Water was added to make 1 liter and the pH was adjusted to 9.8 with sulfuric acid or potassium hydroxide.

| Bleach-fixing solution (BF-1) | |
|---|---|
| Water | 700 ml |
| Ammonium ferric diethylenetriaminepenta-acetate dihydride | 65 g |
| Diethylenetriaminepentaacetic acid | 3 g |
| Ammonium thiosulfate (70% aq. solution) | 100 ml |
| 2-Amino-5-mercapto-1,3,4-thiadiazole | 2.0 g |
| Ammonium sulfite (40% aq. solution) | 27.5 ml |

Water was added to make 1 liter and the pH was adjusted to 5.0 with potassium carbonate or glacial acetic acid.

| Stabilizing solution | |
|---|---|
| Water | 800 ml |
| o-Phenylphenol | 1.0 g |
| 5-Chloro-2-methyl-4-isothiazoline-3-one | 0.02 g |
| 2-Methyl-4-isothiazoline-3-one | 0.02 g |
| Diethylene glycol | 1.0 g |
| Brightener (Chinopal SFP) | 2.0 g |
| 1-Hydroxyethylidene-1,1-diphosphonic acid | 1.8 g |
| Bismuth chloride (45% aq. solution) | 0.65 g |
| Magnesium sulfate heptahydride | 0.2 g |
| PVP (polyvinyl pyrrolidone) | 1.0 g |
| Ammonia water (25% ammonium hydroxide aqueous solution) | 2.5 g |
| Trisodium nitrilotriacetate | 1.5 g |

Water was added to make 1 liter and the pH was adjusted to 7.5 with sulfuric acid or ammonia water.

TABLE 2

| | Amplified developing time: 60 sec. | | | | | |
|---|---|---|---|---|---|---|
| | Yellow image | | Cyan image | | | |
| Sample | Dmin | Dmax | Dmin | Dmax | γW/γS | Remark |
| 101 | 0.05 | 2.08 | 0.04 | 2.23 | 0.93 | Inv. |
| 102 | 0.05 | 1.88 | 0.06 | 2.14 | 0.88 | Comp. |
| 103 | 0.05 | 2.09 | 0.04 | 2.24 | 0.95 | Inv. |
| 104 | 0.05 | 2.08 | 0.04 | 2.28 | 0.95 | Inv. |
| 105 | 0.05 | 2.10 | 0.06 | 2.05 | 0.82 | Comp. |

As can be seen from Table 2, photographic material sample (102) was low in the maximum density of yellow images and it is undesirable. When subjected to amplified-development for 80 sec., the yellow images reached a sufficient maximum density but the minimum density also increased, not achieving a sufficiently high maximum density and low minimum. density. Samples (101), (103) and (104) each led to not only sufficient maximum densities of yellow and cyan images in amplification development of 60 sec. but also preferably stable tone reproduction of the lower (1st) layer irrespective of occurrence of color image formation of the upper (3rd) layer. Although Sample (105) led to a sufficiently high maximum density of yellow images in amplification development of 60 sec., its cyan maximum density became lower and when dye forming reaction occurred in the upper layer, there occurred a decrease of contrast of the lower layer, due to reduced developability., undesirably resulting in markedly varied tone reproduction.

Example 2

Preparation of green-sensitive silver halide emulsion (Em-G1)

Monodisperse cubic grain emulsions, EMP-11A having an average grain size of 0.40 μm and a chloride content of 99.5 mol % and EMP-11B having an average grain size of 0.50 μm and a chloride content of 99.5 mol % were prepared in the same manner as in preparation of EMP-1A of Example 1, except that an adding time of Solutions A1 and B1, and that of C1 and D1 were respectively varied. The emulsion, EMP-11A was optimally chemical-sensitized at 60° C. using the following compounds. The emulsion, EMP-11B was also optimally chemical-sensitized in a similar manner, and then sensitized EMP-11A and EMP-11B emulsions were blended in a ratio of 1:1 based on the silver amount to obtain a green-sensitive silver halide emulsion (Em-G1).

| | |
|---|---|
| Sodium thiosulfate | 1.5 mg/mol AgX |
| Chloroauric acid | 1.0 mg/mol AgX |
| Sensitizing dye GS-1 | $4 \times 10^{-4}$ mol/mol AgX |
| Stabilizer STAB-1 | $3 \times 10^{-4}$ mol/mol AgX |
| Stabilizer STAB-2 | $3 \times 10^{-4}$ mol/mol AgX |
| Stabilizer STAB-3 | $3 \times 10^{-4}$ mol/mol AgX |

GS-1: 5,5'-Diphenyl-9-ethyl-3,3'-(2-sulfoethyl)-oxacarbocyanine-anhydro-triethylamine salt

Preparation of silver halide photographic material (201)

A reflection type support prepared in Example 1 was subjected to corona discharge and provided with a sublayer. Further thereon were coated the following component layers to prepare a silver halide photographic material.

Coating solutions each were prepared so as to have coating amounts as below. Hardeners (H-1) and (H-2) were added. There were also added surfactants, (SU-2) and (SU-3) to adjust surface tension. To each layer was further added (F-1) in an amount of 0.04 g/m$^2$.

| Layer | Constitution | Amount (g/m$^2$) |
|---|---|---|
| 7th layer (Protective layer) | Gelatin | 1.00 |
| | DIDP | 0.002 |
| | DBP | 0.002 |
| | Silicon dioxide | 0.003 |
| 6th layer (UV absorbing layer) | Gelatin | 0.40 |
| | AI-1 | 0.01 |
| | UV absorbent (UV-1) | 0.12 |
| | UV absorbent (UV-2) | 0.04 |
| | UV absorbent (UV-3) | 0.16 |
| | Antistaining agent (HQ-5) | 0.04 |
| | PVP (polyvinyl pyrrolidone) | 0.03 |
| 5th layer (Red-sensitive layer) | Gelatin | 1.30 |
| | Red-sensitive emulsion (Em-R1) | 0.018 |
| | Cyan coupler (C-4) | 0.13 |
| | Dye image stabilizer (ST-1) | 0.10 |
| | Antistaining agent (HQ-1) | 0.004 |
| | DBP | 0.10 |
| | DOP | 0.20 |
| 4th layer (UV absorbing layer) | Gelatin | 0.94 |
| | UV absorbent (UV-1) | 0.28 |
| | UV absorbent (UV-2) | 0.09 |
| | UV absorbent (UV-3) | 0.38 |
| | AI-1 | 0.02 |
| | Antistaining agent (HQ-5) | 0.10 |
| 3rd layer (Green-sensitive layer) | Gelatin layer | 1.30 |
| | AI-2 | 0.01 |
| | Green-sensitive emulsion (Em-G1) | 0.015 |
| | Magenta coupler (M-1) | 0.20 |
| | Dye image stabilizer (ST-3) | 0.20 |
| | Dye image stabilizer (ST-4) | 0.17 |
| | DIDP | 0.13 |
| | DBP | 0.13 |
| 2nd layer (Interlayer) | Gelatin | 1.20 |
| | AI-3 | 0.01 |
| | Antistaining agent (HQ-2) | 0.03 |
| | Antistaining agent (HQ-3) | 0.03 |
| | Antistaining agent (HQ-4) | 0.05 |
| | Antistaining agent (HQ-5) | 0.23 |
| | DIDP | 0.04 |
| | DBP | 0.02 |
| | Brightening agent (W-1) | 0.10 |
| 1st layer (Blue-sensitive layer) | Gelatin | 1.20 |
| | Blue-sensitive Emulsion (Em-B1) | 0.033 |
| | Yellow coupler (Y-1) | 0.70 |
| | Dye image stabilizer (ST-1) | 0.10 |

-continued
| Layer | Constitution | Amount ($g/m^2$) |
|---|---|---|
| | Dye image stabilizer (ST-2) | 0.10 |
| | Dye image stabilizer (ST-5) | 0.10 |
| | Antistaining agent (HQ-1) | 0.01 |
| | Image stabilizer A | 0.15 |
| | DBP | 0.10 |
| | DNP | 0.05 |
-continued
| Layer | Constitution | Amount ($g/m^2$) |
|---|---|---|
| Support | Polyethylene-laminated paper | |
(The coating amount of silver halide was based on silver.)
M-1
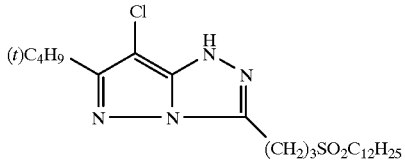
ST-3
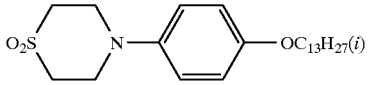
ST-4
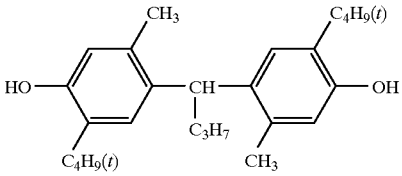
AI-1
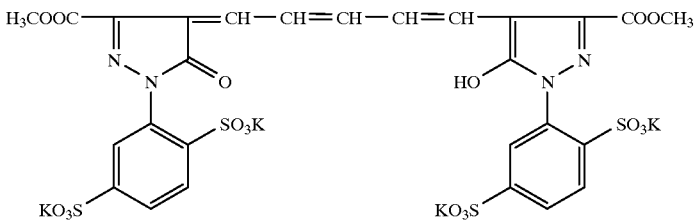
AI-2
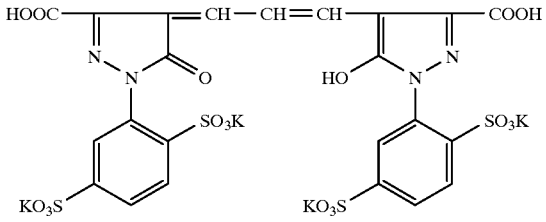
UV-1
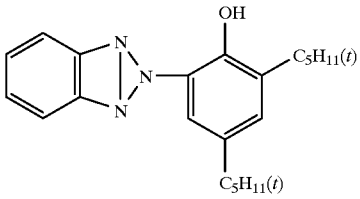

-continued

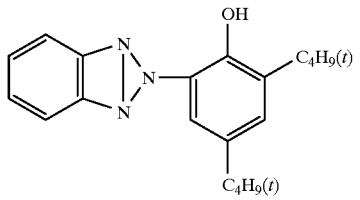

UV-2

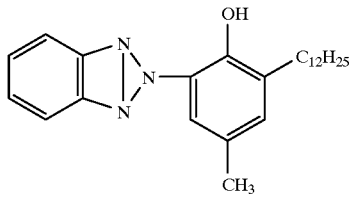

UV-3

Preparation of photographic materials (202) through (209)

Photographic material Samples (202) to (206) were prepared in the same manner as Sample (201) except that the position of the 1st, 3rd and 5th layer was interchanged. For example, Sample (202) was prepared by replacing the 3rd layer and 5th layer of Sample (201) with each other. Samples (207) to (209) were also prepared same manner as Sample (201), except that a cyan coupler employed in the 5th layer was changed to C-2 (0.14 g/m$^2$), C-3 (0.12 g/m$^2$) or C-1 (0.28 g/m$^2$).

TABLE 3

| Sample | 1st layer Coupler | 1st layer ε(× 10$^4$) | 3rd layer Coupler | 3rd layer ε(× 10$^4$) | 5th layer Coupler | 5th layer ε(× 10$^4$) | Remark |
|---|---|---|---|---|---|---|---|
| 201 | Y-1 | 1.5 | M-1 | 5.5 | C-4 | 7.4 | Inv. |
| 202 | Y-1 | 1.5 | C-4 | 7.4 | M-1 | 5.5 | Inv. |
| 203 | M-1 | 5.5 | Y-1 | 1.5 | C-4 | 7.4 | Inv. |
| 204 | M-1 | 5.5 | C-4 | 7.4 | Y-1 | 1.5 | Inv. |
| 205 | C-4 | 7.4 | Y-1 | 1.5 | M-1 | 5.5 | Inv. |
| 206 | C-4 | 7.4 | M-1 | 5.5 | Y-1 | 1.5 | Inv. |
| 207 | Y-1 | 1.5 | M-1 | 5.5 | C-2 | 7.0 | Inv. |
| 208 | Y-1 | 1.5 | M-1 | 5.5 | C-3 | 7.5 | Inv. |
| 209 | Y-1 | 1.5 | M-1 | 5.5 | C-1 | 2.6 | Comp. |

Photographic material samples (201) to (209) each were exposed to white light for 0.5 sec., or exposed to monochromatic light meeting spectral sensitivity of the 1st layer, for 0.5 sec. and subjected to amplification development. Processed photographic material samples were subjected to sensitometry using a densitometer PDA-65 (produced by Konica Corp.) to measure reflection densities based on blue light, green light or red light. After sensitometry, each sample was treated with an aqueous solution of pronase to remove the 2nd to 7th layers for observation of only images formed in the 1st layer, and was again subjected to sensitometry to measure reflection densities. Using these sensitometric results, values of γW/γS of each sample were determined to evaluate stability with respect to tone reproduction in the same manner as in Example 1. Results thereof are shown in Table 4.

Processing:

| Step | Temperature | Time |
|---|---|---|
| Amplified developing (CDA-1) | 33.0 ± 0.5° C. | 75 sec. |
| Bleach-fixing (BF-1) | 35.0 ± 0.5° C. | 20 sec. |
| Stabilizing | 30 to 34° C. | 60 sec. |
| Drying | 60 to 80° C. | 30 sec. |

TABLE 4

| Sample | Yellow image Dmin | Yellow image Dmax | Magenta image Dmin | Magenta image Dmax | Cyan image Dmin | Cyan image Dmax | γW/γS of 1st layer | Remark |
|---|---|---|---|---|---|---|---|---|
| 201 | 0.05 | 2.12 | 0.03 | 2.18 | 0.04 | 2.21 | 0.98 | Inv. |
| 202 | 0.05 | 2.08 | 0.03 | 2.18 | 0.04 | 2.18 | 0.95 | Inv. |
| 203 | 0.05 | 2.12 | 0.03 | 2.08 | 0.04 | 2.22 | 0.98 | Inv. |
| 204 | 0.05 | 2.12 | 0.03 | 2.02 | 0.04 | 2.19 | 0.96 | Inv. |
| 205 | 0.05 | 2.09 | 0.03 | 2.17 | 0.03 | 2.14 | 0.96 | Inv. |
| 206 | 0.06 | 2.11 | 0.03 | 2.08 | 0.03 | 2.14 | 0.95 | Inv. |
| 207 | 0.05 | 2.08 | 0.03 | 2.18 | 0.04 | 2.14 | 0.98 | Inv. |
| 208 | 0.05 | 2.08 | 0.03 | 2.18 | 0.04 | 2.15 | 0.98 | Inv. |
| 209 | 0.05 | 1.98 | 0.03 | 2.18 | 0.06 | 2.12 | 0.92 | Comp. |

In Samples (2-1) to (208), the contrast of the 1st layer was stably reproduced irrespective of dye image formation of the upper layer(s) and there were preferably achieved sufficiently high maximum density and low minimum density in each color image forming layer. It was proved that Samples (201), (203), (207) and (208), in which ε of a dye formed in the image forming layer farthest from the support is the largest, displayed marked effects of the invention and were preferable constituton.

Example 3

Preparation of red-sensitive silver halide emulsion (Em-R2)

Monodisperse cubic grain emulsions, EMP-22A having an average grain size of 0.40 μm, a variation coefficient of grain size of 0.07 and a chloride content of 85 mol % was prepared in the same manner as emulsion EMP-21A of Example 1, except that Solutions A1 and C1 were changed to the following Solutions A2 and C2. An emulsion EMP-22B having an average grain size of 0.38 μm, a variation coefficient of 0.07 and a chloride content of 85 mol % was prepared in the same manner as in preparation of EMP-21A, except that an adding time of Solutions A2 and B1, and that of Solutions C2 and D1 were respectively varied.

| | |
|---|---|
| Solution A2 | |
| Sodium chloride | 2.92 g |
| Potassium bromide | 1.05 g |
| Water to make | 200 ml |
| Solution C2 | |
| Sodium chloride | 87.7 g |
| Potassium hexachloroiridium (IV) | $4 \times 10^{-8}$ mol |
| Potassium hexacyano-iron (II) | $2 \times 10^{-5}$ mol |
| Potassium bromide | 31.5 g |
| Water to make | 600 ml |

Emulsions EMP-22A and EMP-22B were each optimally chemical-sensitized in the same manner as in Emulsion EMP-21A and EMP-21B, and chemically sensitized emulsions EMP-22A and EMP-22B were blended in a ratio of 1:1 to obtain a red-sensitive silver halide emulsion (Em-R2).

Preparation of red-sensitive silver halide emulsion (Em-R3)

Monodisperse cubic grain emulsions, EMP-23A having an average grain size of 0.40 μm, a variation coefficient of grain size of 0.07 and a chloride content of 75 mol % was prepared in the same manner as emulsion EMP-21A of Example 1, except that Solutions A1 and C1 were changed to the following Solutions A3 and C3. An emulsion EMP-22B having an average grain size of 0.38 μm, a variation coefficient of 0.07 and a chloride content of 75 mol % was prepared in the same manner as in preparation of EMP-21A, except that an adding time of Solutions A3 and B1, and that of Solutions C3 and D1 were respectively varied.

| | |
|---|---|
| Solution A3 | |
| Sodium chloride | 2.58 g |
| Potassium bromide | 1.75 g |
| Water to make | 200 ml |
| Solution C3 | |
| Sodium chloride | 77.4 g |
| Potassium hexachloroiridium (IV) | $4 \times 10^{-8}$ mol |
| Potassium hexacyano-iron (II) | $2 \times 10^{-5}$ mol |
| Potassium bromide | 52.4 g |
| Water to make | 600 ml |

Emulsions EMP-23A and EMP-23B were each optimally chemical-sensitized in the same manner as in Emulsion EMP-21A and EMP-21B, and chemically sensitized emulsions EMP-23A and EMP-23B were 89 blended in a ratio of 1:1 to obtain a red-sensitive silver halide ion (Em-R3).

Preparation of silver halide photographic materials (301) to (304)

Photographic material samples (301) and (302) were prepared in the same manner as Sample (209) of Example 2, except that in place of red-sensitive emulsion (Em-R1) were employed emulsions (Em-R2) and (Em-R3). Samples (303) and (304) were prepared in the same manner as Sample (201), except that in place of red-sensitive emulsion (Em-R1) were employedemulsions (Em-R2) and (Em-R3). Thus ed Samples (301) to (304) were each processed and evaluated same manner as in Example 2. Results thereof are shown in 5.

As can be seen from Table 5, in cases when photographic materials (301) to (304) having a silver halide emulsion different in the chloride content, Sample (303) and (304) led to a sufficiently high maximum density and low minimum density in each color image forming layer and stable tone reproduction irrespective of the image dye formation in the upper layer(s). Specifically, photographic material Samples (201) and (303) were shown to highly achieve advantageous effects of the invention and be preferred embodiments of the invention.

TABLE 5

| Sample | AgCl content (mol %)* | Yellow image Dmin | Yellow image Dmax | Magenta image Dmin | Magenta image Dmax | Cyan image Dmin | Cyan image Dmax | γW/γS of 1st layer | Re-mark |
|---|---|---|---|---|---|---|---|---|---|
| 209 | 99.5 | 0.05 | 1.98 | 0.03 | 2.18 | 0.06 | 2.12 | 0.92 | Comp. |
| 301 | 85 | 0.05 | 1.97 | 0.03 | 2.18 | 0.06 | 2.11 | 0.93 | Comp. |
| 302 | 75 | 0.05 | 1.97 | 0.02 | 2.16 | 0.05 | 2.07 | 0.91 | Comp. |
| 201 | 99.5 | 0.05 | 2.12 | 0.03 | 2.18 | 0.04 | 2.21 | 0.98 | Inv. |
| 303 | 85 | 0.05 | 2.11 | 0.03 | 2.18 | 0.03 | 2.19 | 0.97 | Inv. |
| 304 | 75 | 0.04 | 2.08 | 0.02 | 2.16 | 0.03 | 2.15 | 0.95 | Inv. |

*Silver chloride content of silver halide of the 5th layer

Example 4

Preparation of photographic materials (401) to (404)

Photographic material samples (401) to (404) were prepared in the same manner as Sample 201 of Example 2, except that the silver coating amount of the 5th layer was varied as shown in table 6. Thus prepared Samples (401) to (404) were processed and evaluated in the same manner as in example 2. Results thereof are shown in Table 6.

TABLE 6

| Sample | Ag content (mol %)* | Yellow image Dmin | Yellow image Dmax | Magenta image Dmin | Magenta image Dmax | Cyan image Dmin | Cyan image Dmax | γW/γS of 1st layer | Remarks |
|---|---|---|---|---|---|---|---|---|---|
| 201 | 0.018 | 0.05 | 2.12 | 0.03 | 2.18 | 0.04 | 2.21 | 0.98 | Inv. |
| 401 | 0.004 | 0.05 | 2.13 | 0.03 | 2.18 | 0.04 | 2.15 | 0.98 | Inv. |
| 402 | 0.035 | 0.05 | 2.12 | 0.02 | 2.17 | 0.04 | 2.22 | 0.98 | Inv. |
| 403 | 0.057 | 0.05 | 2.12 | 0.03 | 2.16 | 0.05 | 2.23 | 0.97 | Inv. |
| 404 | 0.072 | 0.05 | 2.10 | 0.03 | 2.16 | 0.05 | 2.24 | 0.95 | Inv. |

*Silver amount of the 5th layer

As can be seen from Table 5, Samples (201), (402) and (403) meeting a preferred embodiment of the invention in which the silver coating amount of the image forming layer provided farthest from the support was 5 to 60 mg/m$^2$ $_1$,were shown to superior in the maximum desity and stable tone reproduction of the lowest image forming layer, being one of preferred embodiments of the invention.

Example 5

Preparation of silver halide photographic material (501)

A reflection type support prepared in Example 1 was subjected to corona discharge and provided with a sublayer. Further thereon were coated the following component layers to prepare a silver halide photographic material.

Coating solutions each were prepared so as to have coating amounts as below. Hardeners (H-1) and (H-2) were added. There were also added surfactants, (SU-2) and (SU-3) to adjust surface tension. To each layer was further added (F-1) in an amount of 0.04 g/m$^2$.

| Layer | Constitution | Amount (g/m$^2$) |
|---|---|---|
| 7th layer (Protective layer) | Gelatin | 1.00 |
| | DIDP | 0.002 |
| | DBP | 0.002 |
| | Silicon dioxide | 0.003 |
| 6th layer (UV absorbing layer) | Gelatin | 0.40 |
| | AI-1 | 0.01 |
| | UV absorbent (UV-1) | 0.12 |
| | UV absorbent (UV-2) | 0.04 |
| | UV absorbent (UV-3) | 0.16 |
| | Antistaining agent (HQ-5) | 0.04 |
| | PVP (polvvinyl pyrrolidone) | 0.03 |
| 5th layer (Red-sensitive layer) | Gelatin | 1.30 |
| | Red-sensitive emulsion (Em-R1) | 0.018 |
| | Cyan coupler (C-4) | 0.13 |
| | Dye image stabilizer (ST-1) | 0.10 |
| | Antistaining agent (HQ-1) | 0.004 |
| | DBP | 0.10 |
| | DOP | 0.20 |
| 4th layer (UV absorbing layer) | Gelatin | 0.94 |
| | UV absorbent (UV-1) | 0.28 |
| | UV absorbent (UV-2) | 0.09 |
| | UV absorbent (UV-3) | 0.38 |
| | AI-1 | 0.02 |
| | Antistaining agent (HQ-5) | 0.10 |
| 3rd layer (Green-sensitive layer) | Gelatin layer | 1.30 |
| | AI-2 | 0.01 |
| | Green-sensitive emulsion (Em-G1) | 0.023 |
| | Magenta coupler (M-1) | 0.20 |
| | Dye image stabilizer (ST-3) | 0.20 |
| | DIDP | 0.13 |
| | DBP | 0.13 |
| 2nd layer (Interlayer) | Gelatin | 1.20 |
| | AI-3 | 0.01 |
| | Antistaining agent (HQ-2) | 0.03 |

-continued

| Layer | Constitution | Amount (g/m$^2$) |
|---|---|---|
| | Antistaining agent (HQ-3) | 0.03 |
| | Antistaining agent (HQ-4) | 0.05 |
| | Antistaining agent (HQ-5) | 0.23 |
| | DIDP | 0.04 |
| | DBP | 0.02 |
| | Brightening agent (W-1) | 0.10 |
| 1st layer (Blue-sensitive layer) | Gelatin | 1.20 |
| | Blue-sensitive Emulsion (Em-B1) | 0.043 |
| | Yellow coupler (Y-1) | 0.70 |
| | Dye image stabilizer (ST-2) | 0.10 |
| | DBP | 0.10 |
| | DNP | 0.05 |
| Support | Polyethylene-laminated paper | |

(The coating amount of silver halide was based on silver.)

Samples (502) through (506) were prepared in the same manner as sample (501), except that to the ist layer was added a compound as shown in Table 7. Samples were exposed, through an optical wedge, to blue light for 0.5 sec. and subjected to amplified development in the same manner as in Example 1.

As a measure of background whiteness, reflection density of the white background of each processed sample was measured with blue light, using X-rite 310 densitometer (produced by X-rite Co.).

Further, processed samplee were exposed to sun light over a period of 30 days using a under-glass exposure stand for outdoor use, and a rejection density of a yellow image was measured with blue light with respect to before and after being exposed to determine a fading percentage, based on the following equation:

$$\text{Fading percentage}=100\times(Do-D)/Do$$

where Do is a density before exposed (1.0), and D is a density after exposed. Results are summarized in Table 7.

TABLE 7

| Sample No. | Compound* | $D_B$min | Fading (%) | Remark |
|---|---|---|---|---|
| 501 | — | 0.12 | 35 | Inv. |
| 502 | HQ-1 | 0.15 | 37 | Inv. |
| 503 | ST-4 | 0.17 | 29 | Inv. |
| 504 | 1-16 | 0.12 | 11 | Inv. |
| 505 | 1-19 | 0.12 | 10 | Inv. |
| 506 | 1-20 | 0.12 | 10 | Inv. |

*Added to the 1st layer in an amount of 0.1 g/m$^2$

As be seen from Table 7, the use of the compound represented by formula (1) led to amplification-developed images little in whiteness deteriration and superior in light fastness. Moreover, can be obtained sharp images excellent in color reporduction, even in less silver amount.

Example 7

Photographic material samples 601 to 607 were prepared in the same manner as sample 501 of Example 5, except that to the 3rd layer was added a compound as shown in Table 8. Samples each were exposed to green light for 0.5 sec., processed and evaluated with respect to whiteness and light fastness of magenta images in a manner similar to Example 5. Results thereof are summarizewd in Table 8.

TABLE 8

| Sample No. | Compound* | $D_G$min | Color reproduction | Fading (%) | Remark |
|---|---|---|---|---|---|
| 501 | — | 0.12 | A*** | 44 | Inv. |
| 601 | HQ-1 | 0.15 | B | 54 | Inv. |
| 602 | ST-4 | 0.17 | C | 34 | Inv. |
| 603 | A-11 | 0.12 | A | 37 | Inv. |
| 604 | A-8 | 0.12 | A | 38 | Inv. |
| 605 | 4-2 | 0.12 | A | 39 | Inv. |
| 606 | 4-6 | 0.13 | A | 40 | Inv. |
| 607 | 4-6** | 0.12 | A | 40 | Inv. |

*: Added to 3rd layer in an amount of 0.17 g/m$^2$
**: 0.07 g/m$^2$
***A: Bright magenta
B: Yellowish magenta
C: Bluish magenta As can be seen from Table 8, the use of the compound represented by formula (4) led to magenta images with little deterioration of whiteness in amplified development. Moreover, there can be obtained sharp images excellent in color reproduction, even in less silver amount and superior in light fastness.

What is claimed is:

1. An image forming method of a silver halide sensitive photographic material comprising a support having thereon photographic component layers including at least two color image forming layers containing a silver halide emulsion and a dye forming coupler, said image forming method comprising exposing the photographic material to light and subjecting the exposed photographic material to amplification development to form a dye image, wherein a color image forming layer farthest from said support contains a cyan coupler capable of forming a cyan dye, upon development, having a molar extinction coefficient at a wavelength of an absorption maximum of at least 60,000, said molar extinction coefficient being largest in said color image forming layer farthest from said support, said cyan coupler represented by formula (I), (II), or (III);

formula (I)

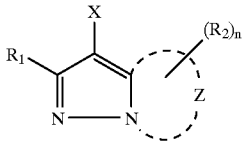

wherein $R_1$ represents a hydrogen atom or a substituent; $R_2$ represents a substituent, provided that at least one of $R_1$ and $R_2$ is selected from the group consisting of an electron-withdrawing group and a group capable of forming a hydrogen bond; n represents a number of the substituent $R_2$; X represents a hydrogen atom or a group capable of being released upon reaction with an oxidation product of a color developing agent; and Z represents a non-metallic atom group necessary for forming an azole ring;

formula (II)

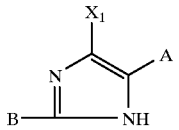

wherein A and B independently represents a substituent bonded to a imidazole ring through a carbon atom, a nitrogen atom, an oxygen atom or a sulfur atom; and $X_1$ represents a hydrogen atom or a group capable of being released upon reaction with an oxidation product of a color developing agent;

formula (III)

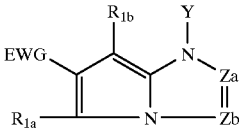

wherein Za represents —C($R_3$)═ or —N═; when Za is —N═, Zb represents —C($R_3$)═ and when Za is —C($R_3$)═, Zb represents —N═, in which $R_3$ represents a hydrogen atom or a substituent; $R_{1a}$, $R_{1b}$ and Y independently represent a hydrogen atom or a substituent; EWG represents an electron-withdrawing group having a Hammett's substituent constant ($\sigma_p$) of 0.3 or more.

2. The image forming method of claim 1 wherein said molar extinction coefficient does not exceed 100,000.

3. The image forming method of claim 1, wherein the color image forming layer of the photographic material contains a silver halide emulsion comprising silver halide grains having an average silver chloride content of 80 mol % or more.

4. The image forming method of claim 1, wherein a coating weight of silver of the color image forming layer provided farthest from the support is 5 to 60 mg/m$^2$.

5. The image forming method of claim 1, wherein at least one of the component layers contains a compound represented by the following formula (1)

formula (1)

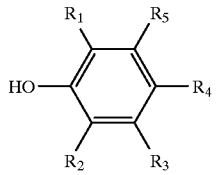

wherein $R_1$ represents a tertiary alkyl group; $R_2$ represents a primary or secondary alkyl group; and $R_3$, $R_4$ and $R_5$ independently represent an alkyl group, alkoxy group, a phenoxy group, an alkoxycarbonyl group, a phenoxycarbonyl group or a phenylthio group.

6. The image forming method of claim 1, wherein at least one of the component layers contains an aliphatic alcohol.

7. The image forming method of claim 1, wherein at least one of the component layers contains a coupler represented by formula (2) or (3) and a compound represented by formula (4):

formula (2)

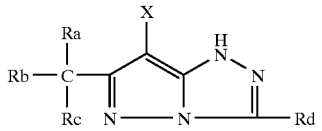

formula (3)

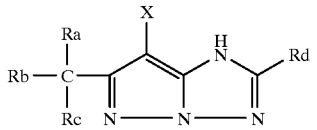

wherein Ra, Rb, Rc and Rd independently represent a hydrogen atom or a substituent, provided that two or more of Ra, Rb and Rc is not hydrogen atoms at the same time; X represents a hydrogen atom or group capable of being released upon reaction with an oxidation product of a developing agent;

formula (4)

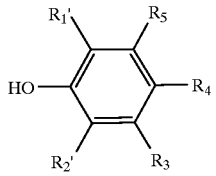

wherein $R_1'$ and $R_2'$ independently an alkyl group; $R_3$, $R_4$ and $R_5$ independently represent an alkyl group, alkoxy group, a phenoxy group, an alkoxycarbonyl group, a phenoxycarbonyl group or a phenylthio group.

* * * * *